US005807003A

United States Patent [19]

Kobayashi et al.

[11] Patent Number: 5,807,003

[45] Date of Patent: Sep. 15, 1998

[54] SHEET DISCHARGE SECTION FOR A PRINTER

[75] Inventors: Yoichi Kobayashi; Tsuyoshi Tomii; Yoji Sasai; Kiyoto Komuro, all of Suwa, Japan

[73] Assignee: Seiko Epson Corporation, Tokyo, Japan

[21] Appl. No.: 653,165

[22] Filed: May 24, 1996

Related U.S. Application Data

[63] Continuation-in-part of Ser. No. 635,317, Apr. 19, 1996, Pat. No. 5,700,099.

[30] Foreign Application Priority Data

May 24, 1995 [JP] Japan ..... 7-149638
May 24, 1995 [JP] Japan ..... 7-149641

[51] Int. Cl.[6] ..... B41J 11/58

[52] U.S. Cl. ..... 400/625; 271/314; 400/629; 400/636

[58] Field of Search ..... 400/624, 625, 400/629, 636; 347/101, 102, 104; 271/209, 314

[56] References Cited

U.S. PATENT DOCUMENTS

| | | | |
|---|---|---|---|
| 4,268,021 | 5/1981 | Rutishauser et al. | 400/625 |
| 4,540,297 | 10/1985 | Imaizumi et al. | 400/625 |
| 4,767,114 | 8/1988 | Nishimoto | 400/625 |
| 5,244,294 | 9/1993 | Ewing | 400/625 |
| 5,391,009 | 2/1995 | Stodder | 400/625 |
| 5,648,807 | 7/1997 | Saito et al. | 347/102 |

FOREIGN PATENT DOCUMENTS

| | | | |
|---|---|---|---|
| 1 267076 | 9/1989 | Japan . | |
| 1-226379 | 9/1989 | Japan | 347/104 |
| 4-366639 | 10/1992 | Japan | 347/104 |
| 6 91861 | 4/1994 | Japan . | |
| 684 469 | 9/1994 | Switzerland . | |

*Primary Examiner*—Christopher A. Bennett
*Attorney, Agent, or Firm*—Stroock & Stroock & Lavan LLP

[57] ABSTRACT

An ink jet printer having a pair of supporting portion for supporting from below both side portions of a sheet to be discharged after characters are printed on the surface of a sheet. At least one of the pair of supporting portion includes a roller, which may be either a driving roller, which conveys discharging sheets from the sheet discharge section, or a driven roller, which rotates upon contacting a discharging sheet to convey the sheet from the sheet discharge section. As a consequence, the sheet is discharged smoothly, without reducing sheet feeding accuracy even when stiff sheets are printed upon by the printer.

8 Claims, 26 Drawing Sheets

59c
82
81g
81f
81
S
82
59d
81
R2
81f
81g
59b
81
81f
81g

59c
T
82
81g
59a
81f
59b
R1
81

59c
59a
59b
81g
82
81f
81

SHEET DISCHARGE SECTION FOR A PRINTER

This is a continuation-in-part application of an application filed on Apr. 19, 1996, entitled Ink Jet Printer, with Ser. No. 08/635,317, now U.S. Pat. No. 5,700,099.

BACKGROUND OF THE INVENTION

1. Field of the Invention

This invention relates generally to ink jet printers, and, in particular, to an improved ink jet printer constructed to more accurately and reliably discharge sheets, including discharging the sheets without causing ink to smear on the already-discharged sheets.

2. Related Art

Ink jet printers are generally designed to produce characters by jetting a stream of ink drops onto sheets. When characters are continuously printed on a plurality of sheets, a succeeding sheet is fed into the printer before the ink on the preceding printed sheet completely dries. Therefore, when the succeeding sheet rubs against the printed side of the preceding sheet upon discharge, the ink may smear.

One ink jet printer construction that has attempted to solve this problem is described in Japanese Unexamined Patent Publication 91861/1994. A perspective view of the sheet discharge portion 690 of this inkjet printer is depicted in FIGS. 27–30. Discharge portion 601 includes a frame 614, which includes thereon a pair of integrally formed supporting portions 612*a* and 612*b*. Supporting portions 612*a*, 612*b* respectively guide and support from below each side portion of sheet P, which has been previously printed upon on an upper surface thereof by means of a printing head (not shown) and is being discharged therefrom. Supporting portions 612*a* and 612*b* may be thin, integrally formed, immovable rib-like members, having their respective upper surfaces 612*a'*, 612*b*' inclined upwards in the sheet discharging direction. A transport section generally indicated as 606 includes a plurality of discharging rollers 682 for discharging sheet P, which is eventually discharged onto discharge plate 605, which may be rotatably mounted with respect to discharge frame 614. Further, located below discharging rollers 682 are driving rollers 607, which drive the sheet forward by making contact with the bottom of the sheet.

An arm, generally indicated at 613*a*, is rotatably mounted on a frame (not shown). Arm 613*a* includes a pushing-down portion 613, rotatably supported thereon, which may be in the form of a thin, plate-shaped, star wheel. Pushing-down portion 613 exerts a downward force on the central portion of the sheet P being discharged from discharge portion 601.

The sheet discharge operation of this conventional type of printer will now be described. Sheet P is printed upon in the print section (not shown) and passes into discharge portion 601. At this time, each side of sheet P is guided upwardly by upper surfaces 612*a*' and 612*b*' of respective supporting portions 612*a* and 612*b*. At the same time, although the central portion of sheet P exerts an upward force on pushing-down portion 613 and rotating arm 613*a*, the central portion of the sheet gradually falls below pushing-down portion 613 and is urged downwardly due to the weight of pushing-down portion 613 and arm 613*a* against the central portion of sheet P. Thus, as sheet P is discharged, it is forcibly urged into a concave shape as viewed in the discharging direction. This type of concave shape may also be achieved without a pushing down portion since the weight of the sheet itself may cause the concavity thereof. Nonetheless, as sheet P is forcibly urged into this concave shape, the sheet will stiffen and will move along in the discharging direction as if it were floating. Because of this, as is more particularly depicted in FIG. 28, the time until discharged sheet P slidably contacts a printed surface P1*f* of sheet P1 (sheet that was previously printed, discharged, and stacked on a sheet discharge tray 605) will be delayed. This method of delaying the subsequent sheet from contacting the previously discharged sheet allows sufficient time for the ink to dry on printed sheet P1 before contact with sheet P takes place.

FIG. 29 illustrates sheet P after it has been further discharged from discharge portion 601, and its trailing edge Pb has passed transport section 606. At this time, sheet P loses its transporting force in the discharge direction because discharge rollers 682' cease acting on sheet P. The rear portion Pc of sheet P is maintained in its concave state, however, by the downward force of pushing-down portion 613 upon the central portion of rear portion Pc of sheet P and the upward force of support portions 612*a*, 612*b* upon the sides of sheet P.

As shown in FIG. 30, as a subsequent sheet of sheet P2 enters transport portion 606 it is urged forward by discharge rollers 682 and, as a result, its leading edge P2*a* passes transport section 601. When leading edge P2*a* contacts trailing edge Pb of the preceding sheet P, preceding sheet P is stacked on the earlier printed sheet P1 (FIG. 28). The time until sheet P2 contacts printed sheet P1 is delayed in the same manner sheet P was delayed, described above.

When a relatively stiff sheet, such as an envelope or a postcard, is used in a conventional ink jet printer, during discharge the stiff sheet may discharge irregularly due to the friction it encounters as it travels over upper surfaces 612*a*' and 612*b*' of supporting portions 612*a* and 612*b*. Because the stiff sheet resists bending and the upper surfaces are positioned at a relatively high level, the discharge of the stiff sheet becomes unreliable and may result in a sheet jam.

Accordingly, a printer that overcomes the aforementioned disadvantages and limitations, readily discharges, supports and guides sheets of different sizes and kinds is desired.

SUMMARY OF THE INVENTION

A printer includes a pair of supporting portions for supporting from below both side portions of a sheet to be discharged after characters are printed on the surface of the sheet by means of a printing section having an ink jet head. At least one of the pair of supporting portions is a roller, which may be a driving roller for driving the discharging sheet forward or a driven roller, which is rotated by contact with the discharging of the sheet. Further, one of the supporting portions may be a driving roller for driving discharging the sheet, while the other supporting portion is a driven roller, which is rotated by contact with discharging sheet. Finally, both supporting portions may be driving rollers or driven rollers.

Accordingly, it is an object of the present invention to provide an improved printer that can more reliably discharge sheets.

Another object of the present invention is to provide an improved printer which can discharge sheets without the ink on previous sheets being smeared.

Still another object of the present invention made to solve the foregoing problems is to provide a printer capable of smoothly discharging even stiff sheets without lowering the accuracy of sheet feeding and without marking the surface of the discharged sheet with conspicuous traces of ink.

Yet another object of the present invention is to provide an ink jet printer which can reliably discharge sheets of different types and sizes.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated by the claims.

BRIEF DESCRIPTION OF THE DRAWINGS

For a fuller understanding of the invention, reference is made to the following description taken in connection with the accompanying drawings in which:

FIG. 11(*b*) is an elevational view a portion of the printer constructed in accordance with the invention;

FIG. 15(*c*) is a schematic view of a sheet passing between the printing section and a regulating member constructed in accordance with the present invention;

FIG. 17(*b*) is a schematic view illustrating a rib member constructed in accordance with the present invention;

FIGS. 23(*a*)(2), 23 (*b*)(2), 23(*c*)(2) and 23(*d*)(2) are schematic elevational views of the corresponding plan views showing the operation of the sheet discharge assembly;

FIG. 26(*b*) is a sectional view of a printer constructed in accordance with the second embodiment.

DETAILED DESCRIPTION OF PREFERRED EMBODIMENT

Figure 1:
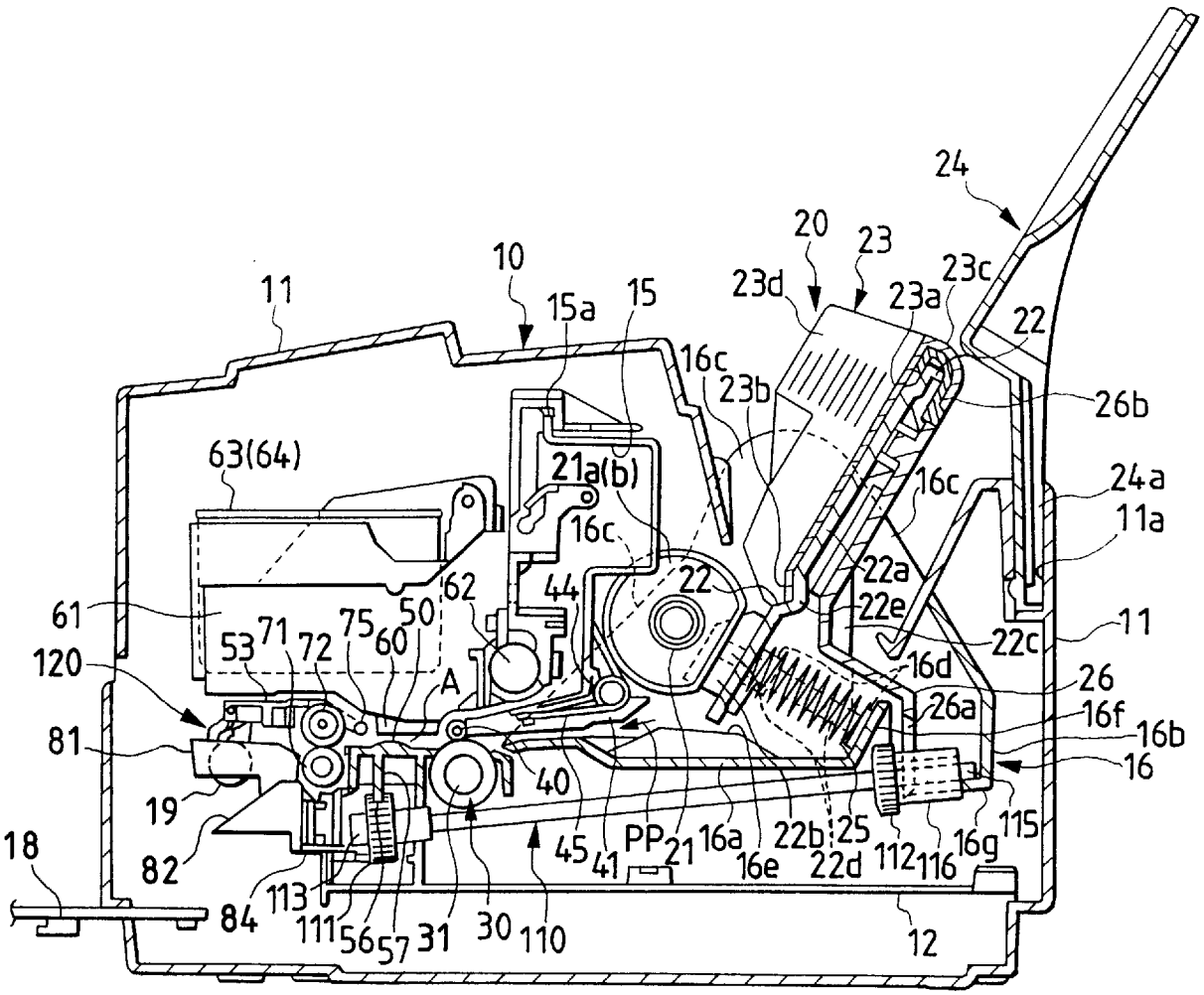
FIG. 1 is a sectional view of an ink jet printer constructed in accordance with a first embodiment of the present invention.
Figure 2:
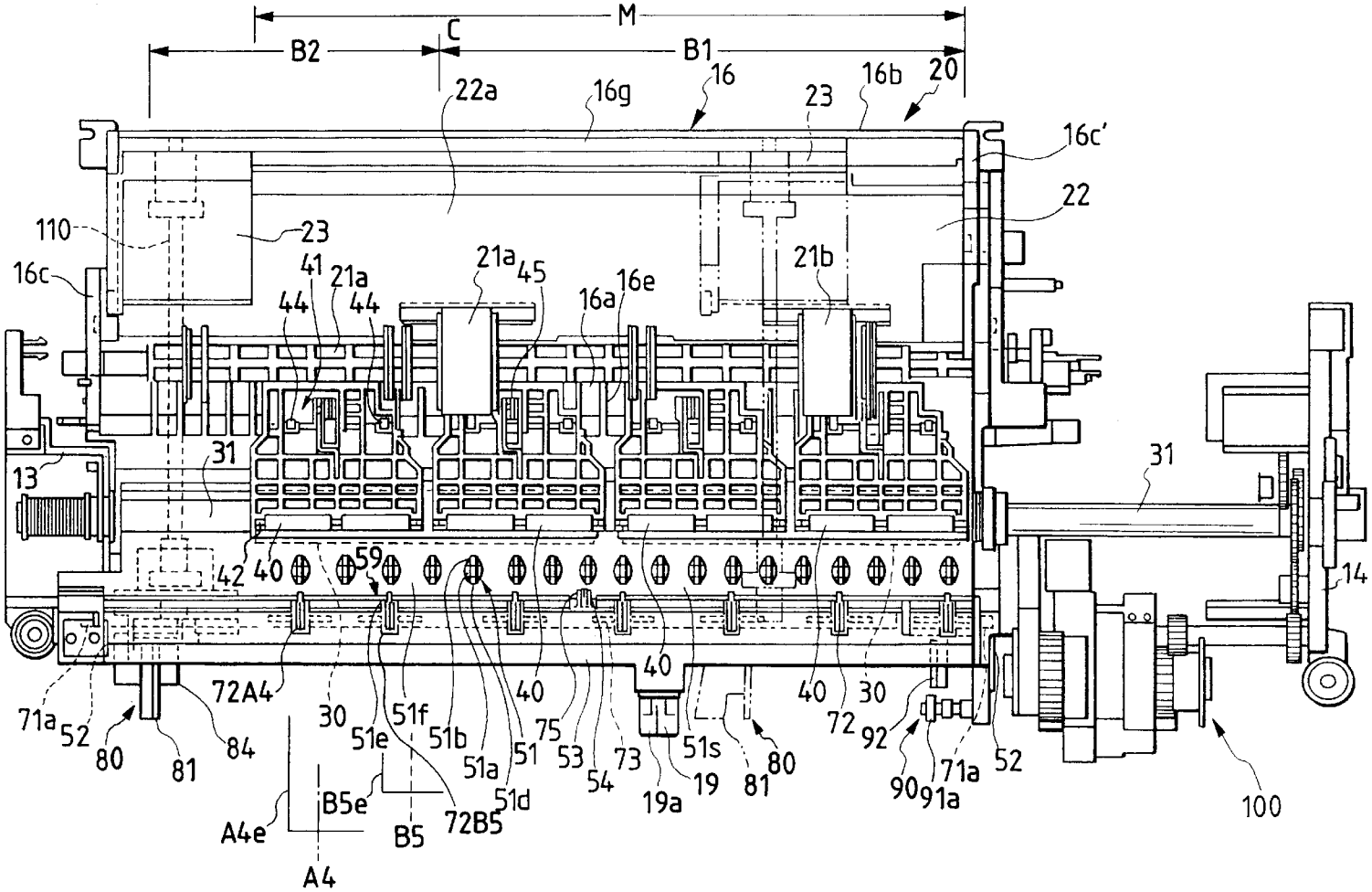
FIG. 2 is a partial top plan view of the ink jet printer constructed in accordance with the invention.

Reference is first made to FIGS. 1 and 2, which depict a printer body, generally indicated at 10, of a printer that, by way of example, may be an ink jet printer, constructed in accordance with a first embodiment of the present invention. Printer body 10 includes a printer case 11 within which an automatic sheet feeder apparatus 20 is positioned. More particularly, automatic sheet feeder apparatus 20 is positioned in the upper rear portion of printer body 10.

Generally speaking, printer body 10 is supplied with sheet P from automatic sheet feeder apparatus 20. Printer body 10 includes two sheet feed rollers 30, rotatably mounted in body 10, and driven pinch rollers 40, rotatably mounted in printer body 10 and in pressing contact with sheet feed rollers 30. A regulating member 50 for guiding the bottom surface of a sheet is mounted in printer body 10. A print head 60 for discharging ink onto a sheet is mounted on a reciprocating carriage 61 in facing relationship across a gap with regulating member 50. A guide roller 75 for urging the sheet through the discharge section is rotatably mounted in printer body 10. At least one pair of discharge rollers 71 and 72 is rotatably mounted in printer body 10. A discharge portion, generally indicated at 120, is mounted in printer body 10 along the sheet feed path PP for sheet P (see FIG. 3). Discharge portion 120 is positioned in the front lower portion of printer body 10. A discharge tray 18 for stacking sheets discharged from discharge portion 120 is positioned apart from and below discharge portion 120.

Printer body 10 also includes a lower portion frame 12 within printer case 11 preferably made of a metal plate and serving as a shield plate, a left side frame 13 and a right side frame 14 preferably made of plastic and positioned in lower frame 12. An intermediate frame 15, made of a metal plate, is positioned within side frames 13 and 14. A sub frame, generally indicated at 16, is mounted within printer case 11 and is preferably made of plastic. Sub frame 16 fixes each of the above-described frames in their proper position.

Still further, sub frame 16 includes a lower plate 16*a* forming a lower portion of sheet feed path PP (FIG. 3), a back plate 16*b*, integrally formed with lower plate 16*a*, and side plates 16*c* and 16*c*', integrally formed with lower plate 16*a* and back plate 16*b*, located on opposed sides of printer body 10 as shown in FIG. 2. A plurality of rib-shaped sheet guides 16*e* extend from the top surface of lower plate 16*a*.

Automatic sheet feeder apparatus 20 includes a grooved sheet feed roller shaft 21 which is rotatably supported in side plates 16*c* and 16*c'* of sub frame 16, and at the time of sheet feeding, is rotatably driven by a transmission mechanism (not shown) connected to a drive mechanism 100. Two sheet feed rollers 21*a* and 21*b* are rotatably mounted on sheet feed roller shaft 21. Sheet feed rollers 21*a* and 21*b* are each preferably constructed as D-shaped rollers having an outer rubber surface layer. Automatic sheet feed apparatus 20 also includes a hopper 22, an edge guide 23, and a sheet feeder tray 24.

Hopper 22 includes a lower plate 22*a* for supporting a lower surface of a sheet, side plates 22*b* integrally formed with lower plate 22*a* (only one side of which is shown by way of example in FIG. 1), triangular side plates 22*c* also integrally formed with lower plate 22*a* (only one side of which is shown by way of example in FIG. 1), and pins 22*d* integrally projected sideways from side plates 22*b* and 22*c*. Pins 22*d* engage with elongated slots 16*d* formed in side plate 16*c* of sub frame 16, thereby permitting hopper 22 to move diagonally upwardly and downwardly relative to sub frame 16. Hopper springs 25 are provided between hopper 22 and lower plate 16*a* of sub frame 16, and urge hopper 22 in a diagonally upward direction relative to sub frame 16. Furthermore, hopper springs 25 may be positioned essentially below (See FIG. 1) sheet feed rollers 21*a* and 21*b*. A cam mechanism (not shown) is operatively connected to drive mechanism 100 and is positioned in side plates 16*c* and 16*c* of sub frame 16 to push hopper 22 against the spring force of hopper springs 25. When sheets are supplied, hopper 22 is pushed upwards by hopper springs 25, thereby pushing the sheet toward sheet feed rollers 21*a* and 21*b*. After the sheet is fed to sheet feed rollers 21*a* and 21*b*, hopper 22 is urged downward by the downward force provided by the cam mechanism and thus moves downwardly with respect to sheet feed rollers 21*a* and 21*b*, thereby preventing sheets from being fed to sheet feed rollers 21*a* and 21*b*.

Edge guide 23 includes a lower plate 23*a*, a bent portion 23*b* positioned in the leading edge portion of lower plate 23*a*, a clip portion 23*c* provided in the rear portion of edge guide 23, a side plate 23*d* connected to lower plate 23*a*, and a connecting plate 26. Edge guide 23 is slidably fitted onto hopper 22 by the engagement of bent portion 23*b* and a groove 22*e* in lower plate 22*a*. Clip portion 23*c* wraps over the rear portion (the upper end portion) of hopper 22 and holds edge guide 23 in place. Side plate 23*d* of edge guide 23 aligns the left edge of a sheet (not shown) set in the top of hopper 22. The right side of the sheet is guided by the upper portion inside surface of side plate 16*c* on the right side of sub frame 16.

As shown in FIG. 1, sheet feeder tray 24 is detachably fitted to printer body 10 by an insertion piece 24*a* formed in the lower portion of sheet feeder tray 24. Insertion piece 24*a* is inserted into insertion slot 11*a* provided in case 11 of printer body 10. With sheet feeder tray 24 inserted into case 11, sheet feeder tray 24 cooperates with hopper 22 to support the lower surface of a sheet. When the automatic sheet feeder apparatus is not operating, i.e., when hopper 22 is in a pushed-down state caused by the previously described cam mechanism, the operation for setting sheets in automatic sheet feeder apparatus 20 requires the insertion of one or more sheets from an upward direction into sheet feeder tray 24.

When the automatic sheet feeder apparatus 20 is operating with the sheet set in sheet feeder tray 24, the cam mechanism releases pressure in hopper 22 and causes hopper 22 to be urged upwardly by hopper springs 25. This upward movement by hopper 22 brings into contact only the uppermost sheet in hopper 22 with sheet feed rollers 21 and 21*b*. In this manner, a single sheet is conveyed to sheet feed path PP.

Figure 11A:
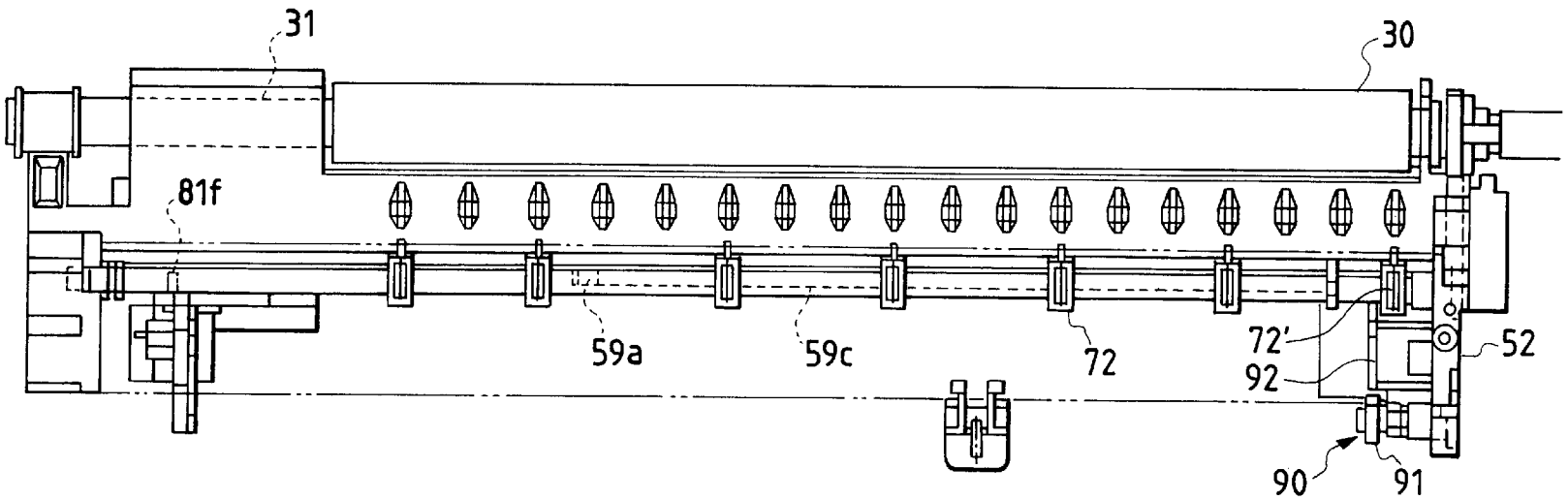
FIG. 11(*a*) is a top plan view of a portion of the printer constructed in accordance with the invention.
Figure 11B:
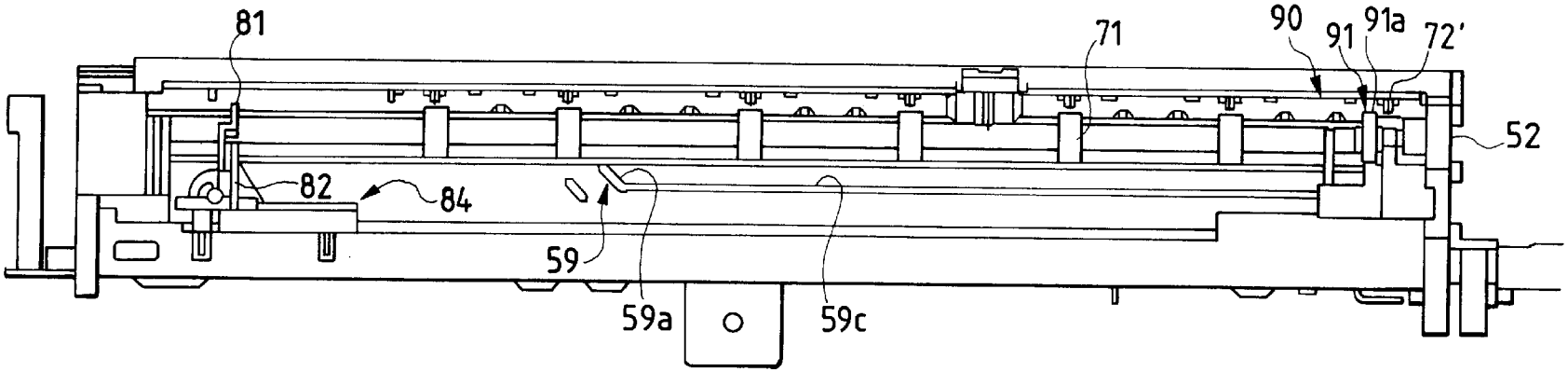

As shown in FIGS. 2 and 11(*a*), a sheet feed roller shaft 31 is rotatably supported by side frames 13 and 14 and is rotatably driven by drive mechanism 100. Sheet feed rollers 30 are preferably two comparatively long, round, rod-shaped rubber rollers, rotatably mounted on sheet feed roller shaft 31. When shaft 31 is driven by drive mechanism 100, shaft 31 and sheet feed rollers 30 rotate and cause the sheet to advance one line at a time. Prior to each advancement of the sheets, print head 60 and drive mechanism 100 cooperate so that print head 60 moves across the sheet and is positioned for printing the next line of print.

Figure 3:
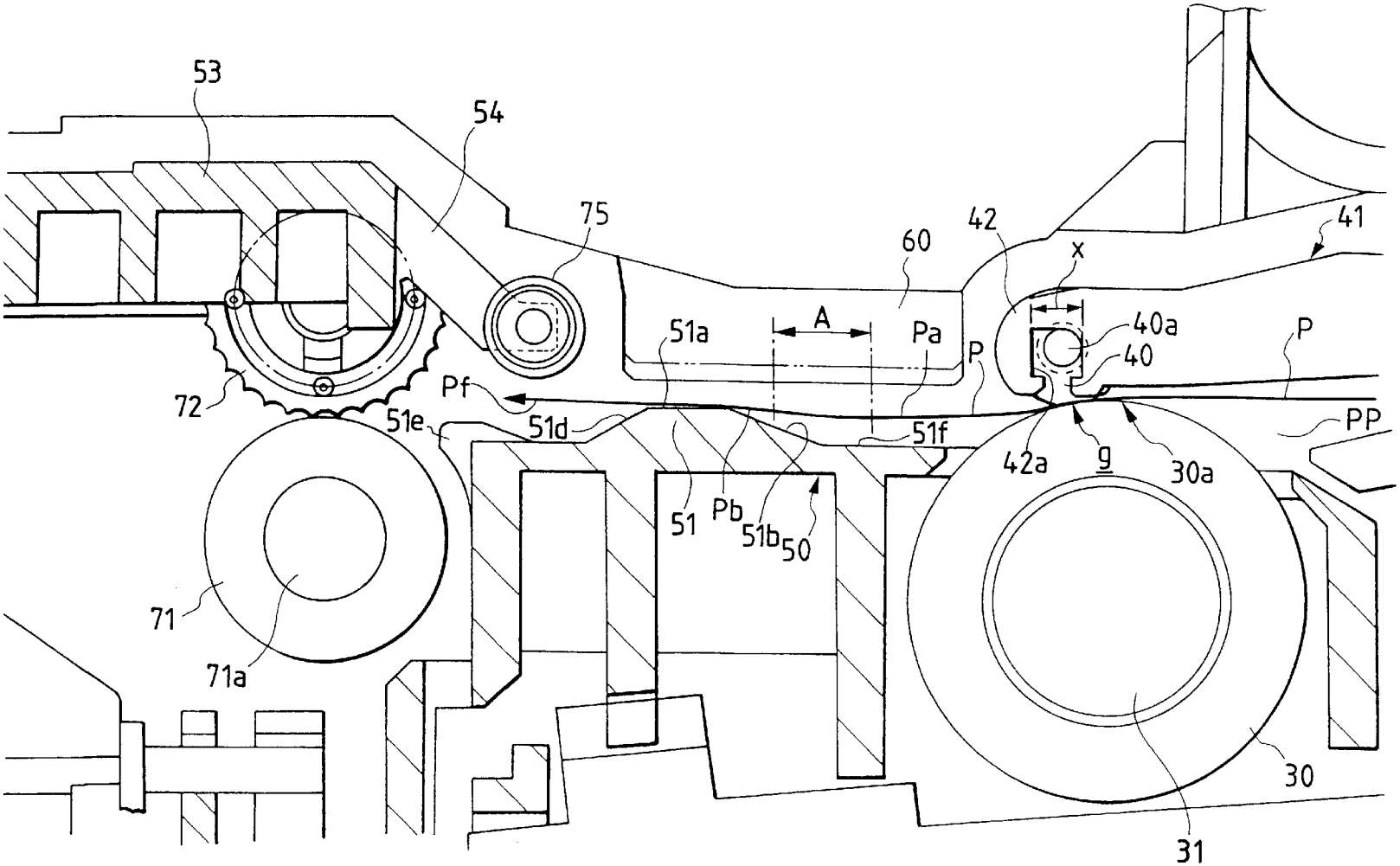
FIG. 3 is an enlarged sectional view of a portion of the inkjet printer constructed in accordance with the invention.

As shown in FIG. 3 in greater detail, holders 41 which include integrally formed cam portions 42, function as sheet guides and form the upper portion of sheet feed path PP. As shown in FIGS. 1 and 2, a pair of hooks 44 are formed in the upper portion of holders 41. These hooks support holders 41 in position on intermediate frame 15 such that holders 41 are capable of oscillation. Rectangular holes 42*a* are formed in portions 42 of holders 41. A shaft 40*a* is rotatably supported and capable of shifting in the directions shown by arrow X within rectangular holes 42*a*. Pinch rollers 40 are preferably round, rod-shaped metal rollers, are supported on shaft 40*a* and oppose sheet feed rollers 30. In a preferred embodiment, four pinch rollers are provided for each sheet feed roller 30. Springs 45 are provided between holders 41 and intermediate frame 15. As shown in FIG. 3, pinch rollers 40 abut sheet feed rollers 30 at a position g, which is slightly downstream in the sheet-conveying direction from a position indicated as the top, 30*a*, of sheet feed rollers 30. This slight forward alignment of pinch rollers 40, caused by the urging force of springs 45, along with the way shaft 40*a* is supported (see above), allows pinch rollers 40 to abut sheet feeder rollers 30 with an automatic center-regulation function when pinch rollers 40 are rotatably driven by sheet feed rollers 30.

A regulating member 50 is fixed in lower portion frame 12 and arranged on the bottom surface-side of a sheet P conveyed by sheet feed rollers 30. Regulating member 50 includes a horizontal flat portion 51*f* positioned opposite print head 60 and a plurality of ribs 51 integrally projected in an upward direction from horizontal portion 51*f*. Ribs 51 extend perpendicular to the sheet-conveying direction, and have an inclined surface 51*b*, a top surface 51*a* connected to inclined surface 51*b*, and declined surface 51*d* connected to top surface 51*a*. When viewed from the side as shown in FIG. 3, these surfaces form a substantially trapezoidal profile and elongate in the sheet-conveying direction.

Inclined surface 51*b* guides the leading edge of a sheet fed by sheet feed rollers 30. Top surface 51*a* abuts the bottom surface Pb of the sheet and regulates the gap between the sheet P and print head 60. Guide portion 51*e* is provided on the upstream side of discharge rollers 71 and 72 and positioned downstream of ribs 51. Guide portion 51*e* guides the leading edge Pf of sheet P toward discharge rollers 71 and 72, and is preferably only provided on the upstream side of discharge rollers 71 and 72.

As shown in FIG. 1, guide shaft 62 and upper edge 15*a* of intermediate frame 15 support and guide carriage 61. Print head 60 is mounted on carriage 61. Carriage 61 moves reciprocally in a direction perpendicular to the sheet-conveying direction by a drive force from a carriage motor (not shown). A monochrome ink tank 63 and a color ink tank 64 may both be installed on carriage 61 next to each other in a direction perpendicular to the sheet-conveying direction so that print head 60 is capable of color printing.

Figure 18A:
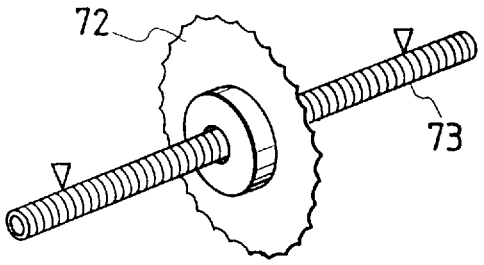
FIGS. 18(*a*) and 18(*b*) are perspective views of a serrated roller constructed in accordance with the present invention.
Figure 18B:
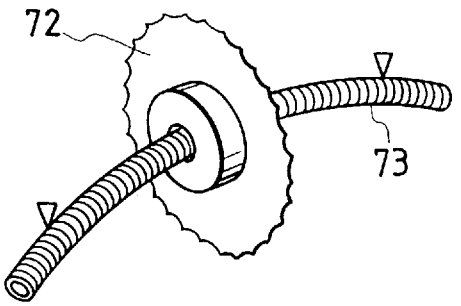

As shown in FIG. 2, a shaft 71*a* is rotatably supported in a side plate 52 of regulating member 50. A plurality of pairs of discharge rollers 71 and 72 (7 pairs are depicted in FIG. 2) are arranged along the width of the sheet feed path. Rollers 71 are rotatably mounted on shaft 71*a*. Roller 71 of one end of the pairs of discharge rollers 71 and 72 is preferably constructed of a rubber roller and is rotatably driven by drive mechanism 100 by a transmission mechanism (not shown). Rollers 71 contact rollers 72, which may be thin plate-shaped, star wheels, but are preferably rotatably driven, serrated rollers. As depicted in FIG. 18(*a*), each serrated roller 72 is rotatably supported on a round, rod-shaped coil spring 73 (which acts as a shaft) and is supported by a support plate 53 mounted in the printer body (see FIGS. 3 and 12). Serrated roller 72 contacts roller 71 by the spring force of coil spring 73. In the case of thick sheets, such as envelopes, serrated roller 72 does not press hard against the sheet so as to impede the sheet conveyance operation, but rather, rises upwards as shown in FIG. 18(*b*). The rotational speed of the pairs of discharge rollers 71 and 72, which directly corresponds to the conveying speed of the sheet, is set so that the linear speed of the sheet through discharge rollers 71 and 72 is faster than the linear speed of the sheet through sheet feed rollers 30. As a result, when the leading edge of sheet P reaches the discharge rollers 71 and 72, the sheet is taut between the discharge rollers and the sheet feed rollers.

Top surface 51*a* of ribs 51 of regulating member 50 is positioned slightly downstream of print head 60 when viewed in the sheet-conveying direction. This results in the sheet P being urged towards the head 60. When the front and rear portions of sheet P, pass over regulating member 50, they are conveyed while being urged downwardly toward regulating member 50 by sheet feed rollers 30, pinch rollers 40 , and discharge rollers 71 and 72. The bottom surface Pb of the sheet reliably abuts the top surface 51*a* of the ribs 51.

Support plate 53 includes an arm 54 integrally formed and slanted downward therefrom. A guide roller 75 is rotatably mounted at the end of arm 54. Guide roller 75 is positioned between a printing section A and pairs of discharge rollers 71 and 72. Printing section A prints on a printing sheet of a suitable recording medium, such as paper. In the undesirable situation where sheet P is warped, the sheet contacts guide roller 75 and is guided toward the pairs of discharge rollers 71 and 72. Guide roller 75 preferably has a small diameter and may be located close to print head 60 so as to be capable of guiding a warped sheet more accurately. Guide roller 75 is preferably formed of a water-repellent plastic and, as shown in FIG. 2, may be positioned such that it contacts a thick sheet, such as an envelope, midway across its width.

It is therefore clear from FIG. 1 that as sheet P is supplied from automatic sheet feeder apparatus 20, passes through concavely curved sheet feed path PP, and reaches sheet feed rollers 30, the feeding angle is regulated by pinch roller 40 as it is fed through sheet feed roller 30. The leading edge of sheet P is guided by regulating member 50, which also functions as a guide member. Sheet P is guided such that its bottom surface Pb abuts the top surfaces of ribs 51*a*, formed on the upper surfaces of regulating member 50, and such that the gap between the surface of sheet P and print head 60 is regulated, while ink is discharged from print head 60 onto the top surface Pa of sheet P, and printing is carried out. The printed sheet P passes through the pairs of discharge rollers 71 and 72 and discharge portion 120, and is discharged onto discharge tray 18.

As shown in FIG. 2, discharge portion 120 includes a roller 19 for pushing the center of a sheet downwards, a slider 84, which will be discussed below, and first and second support assemblies 80 and 90, which support from below, respective side portions of a sheet discharged by pairs of discharge rollers 71 and 72. As shown in FIGS. 11–14, support assembly 90, which will be discussed in greater detail below, includes a driving roller 91 and a guide plate 92.

Figure 5:
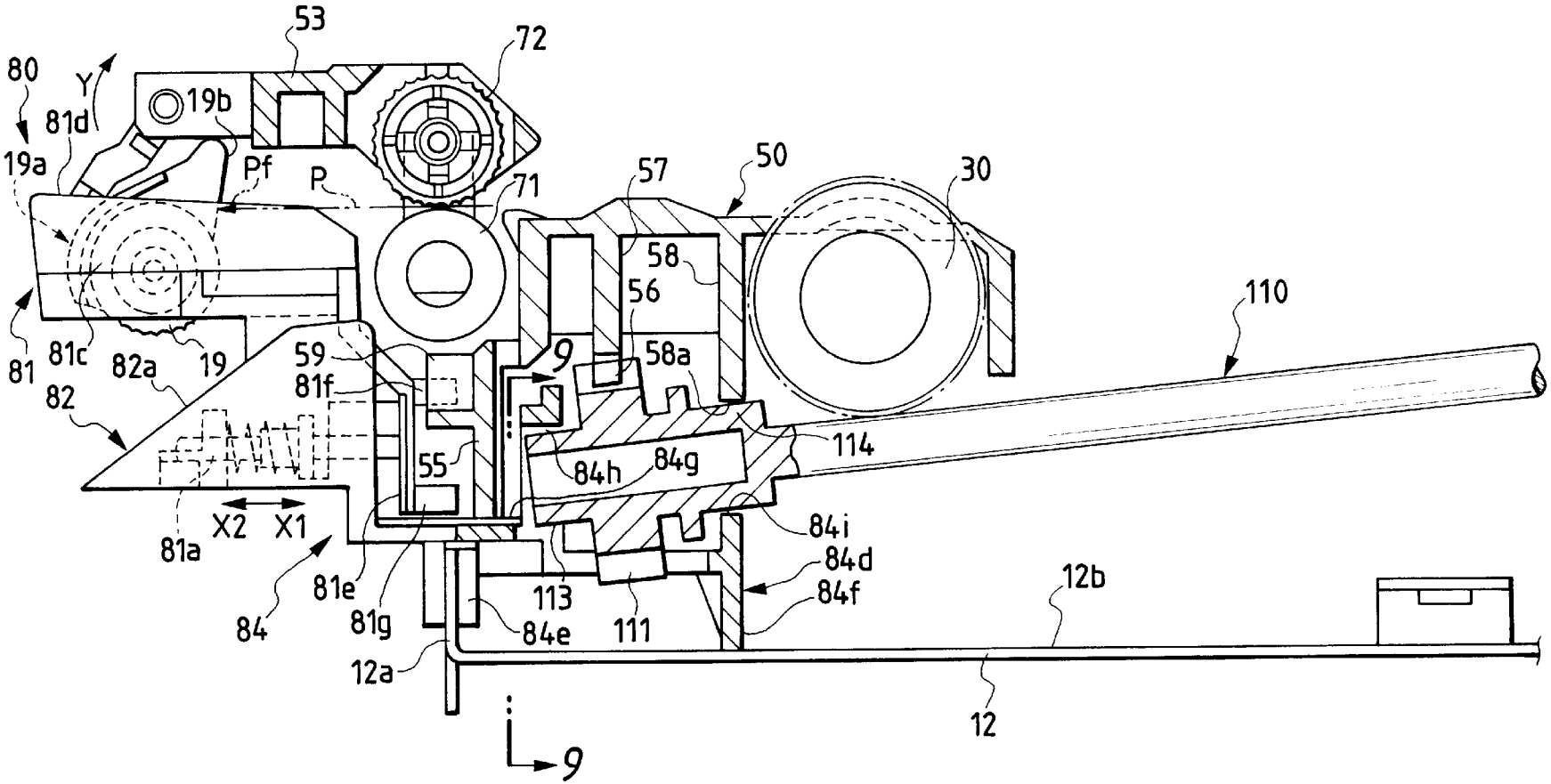
FIG. 5 is an enlarged fragmented sectional view of the printer constructed in accordance with the invention.
Figure 6:
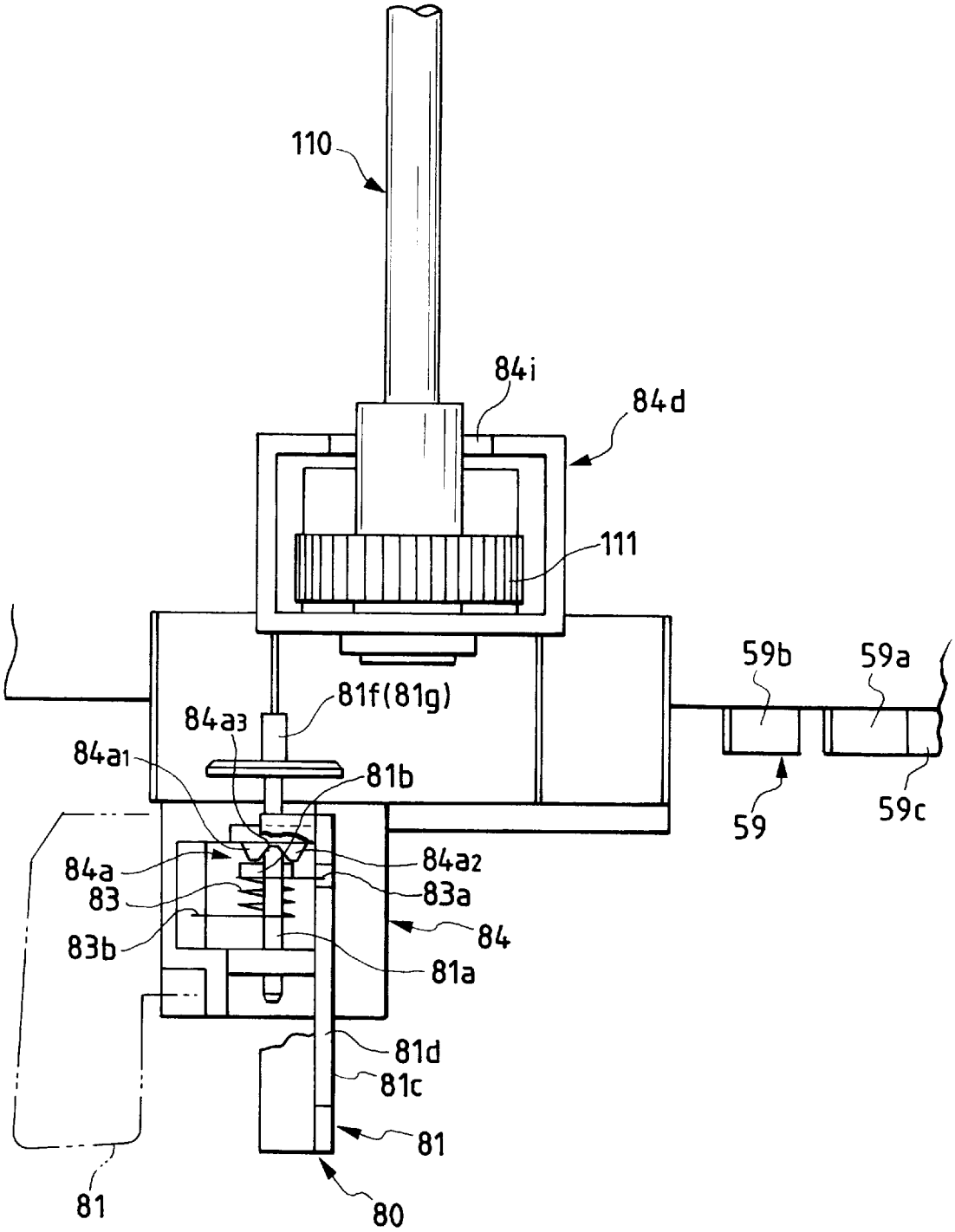
FIG. 6 is an enlarged top plan view of a portion of the printer constructed in accordance with the invention.
Figure 7:
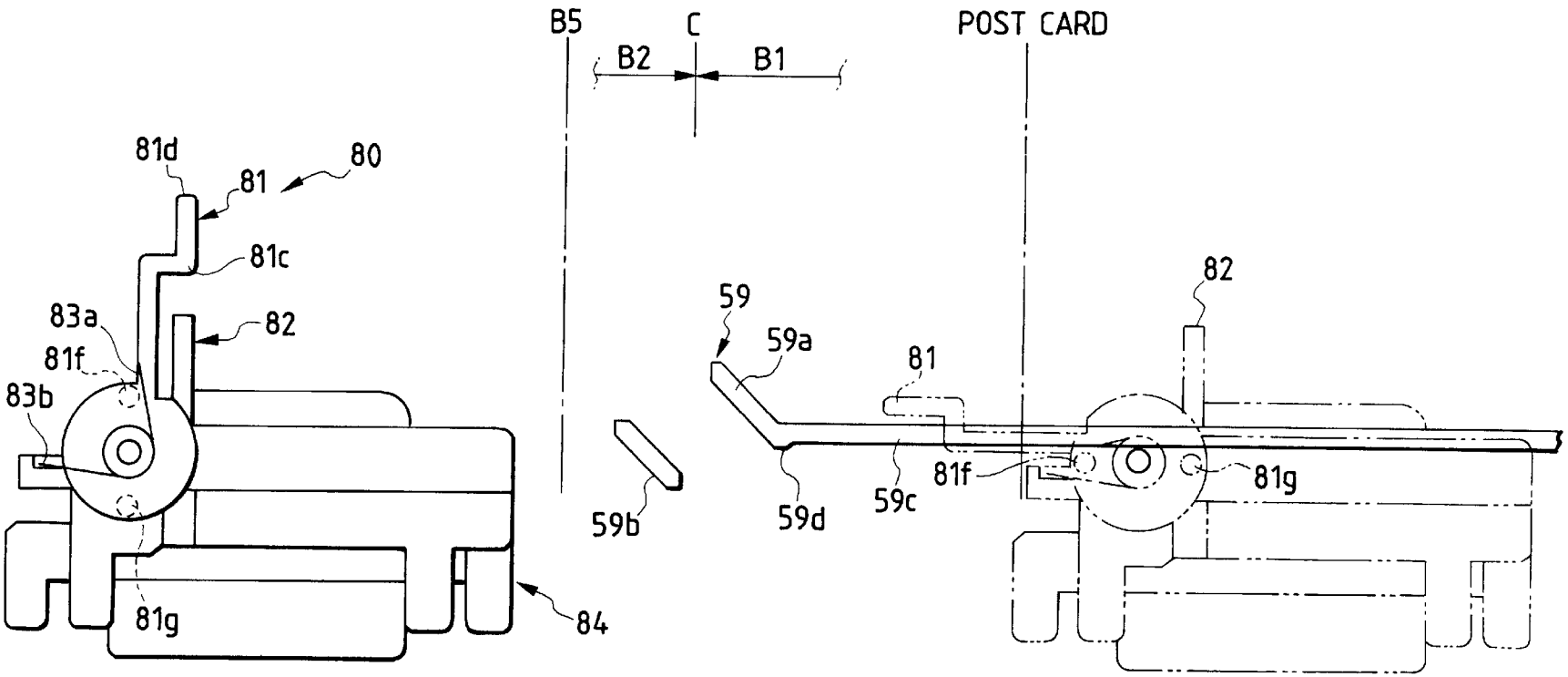
FIG. 7 is an enlarged front elevational view of a switch operated in accordance with the invention showing one support in the upright position and in a non-support position (in chain line) constructed in accordance with the invention.

Reference is now made to FIGS. 5–7 which depict sliding support assembly 80 of discharge portion 120 in greater detail. Support assembly 80 is mounted on slider 84 and is slidable in a direction perpendicular to (along the width of) the sheet feed path PP. Support assembly 80 also includes a first and second support member 81 and 82, respectively. The first support member 81 is used for guiding and supporting from below a first end (as viewed from a leading edge of discharging sheet) of a relatively flexible sheet, such as ordinary sheet of A4 or B5 size, whereas second support member 82 is used for guiding and supporting the first end of a relatively firm copying sheet, such as envelopes and postcards.

As shown in FIGS. 5 and 6, shaft 81*a* is rotatably mounted to slider 84 and is integrally formed with first support member 81. Shaft 81*a* is capable of both rotation and displacement in either of the directions of arrows X1 and X2. A disk-like arm 81*e* is integrally formed at the trailing edge of shaft 81*a* of support member 81. An upper pin 81*f* and lower pin 81*g* are each integrally projected from the upper and lower rear portions of arm 81*e*. Shaft 81*a* is fitted with pull-spring 83, one end 83*a* of which is retained by first support member 81, the other end 83*b* being retained by slider 84. Pull-spring 83 exerts a force on first support member 81 in the direction of arrow X1 and also urges first support member 81 in an upright position as is discussed below.

As shown in FIGS. 6 and 7, a detent or retaining portion 84*a* is formed in the upstream side of slider 84, and a lower portion 81*b* of first support member 81 engages with and disengages from detent portion 84*a* by a clicking operation. The detent portion 84*a* includes two protruding portions 84*a*1 and 84*a*2, and one recess portion 84*a*3, such that when lower portion 81*b* engages with recess portion 84*a*3 of detent portion 84*a*, support member 81 stands upright in the same way as support member 82. When a threshold force is applied to the upper portion 81*c* of support member 81 by a switch 59, which is described below, lower portion 81*b* is displaced from recess portion 84*a*3 of detent portion 84*a*, and simultaneously shaft 81*a* rotates in a counterclockwise direction and moves in the direction of the arrow X2 (see FIG. 5), thereby causing support member 81 to fall to a prone, non-supporting position. Support member 81 is shown in its upright and prone positions in FIGS. 6 and 7. The prone position of support member 81 is indicated by chain lines.

When first support member 81 turns by more than a predetermined angle, lower portion 81*b* abuts against the lower face of left protruding portion 84*a*1 of detent portion 84*a* to brace support member 81 in a prone position. That is, detent portion 84*a* also forms the retaining portion of support member 81. When a clockwise rotational force is applied by switch 59, which is described below, to shaft 81*a*, the first support member 81 stands upright in response to the force exerted by pull-spring 83. Lower portion 81*b* engages with recess portion 84*a*3 of detent portion 84*a* and maintains support member 81 in an upright position.

In the present embodiment, the upright position of support member 81 is a supporting position, where the side portions of a sheet are supported from below. The prone position is a non-supporting position, where the side portions of a sheet are not supported.

As shown in FIG. 5, the upper edge face 81*d* of support member 81 in the upright position forms a support face that gently slopes upward in the sheet feed direction. The support face formed by upper edge 81*d* is situated slightly above the sheet discharged by the pairs of sheet discharge rollers 71 and 72 so as to guide the copying sheet at a slightly upward angle.

Switch 59 is integrally formed on the front of defining member 50. As shown in FIG. 7, switch 59 is provided within the sliding range of slidable support assembly 80 and includes a first and second tilted plate 59*a* and 59*b* which form a camming surface acting as a guide body. Switch 59 is provided at a boundary position C between ranges B2 and B1. Range B2 corresponds to a range of sheet widths at which the side portions of a sheet need support by support member 81, while range B1 corresponds to a range of sheet widths at which the side portions of a sheet need no support. As shown in FIGS. 6 and 7, rail 59*c* extend from and is integrally formed at the lower end of first plate 59*a* to form an acute angle therewith. A protrusion 59*d*, integrally formed at the junction of first tilted plate 59*a* and rail 59*c*, protrudes slightly below rail 59*c*. First and second plates 59*a* and 59*b* are positioned so that they are offset slightly in the vertical direction from each other.

Figures 8A, 8B, 8C:
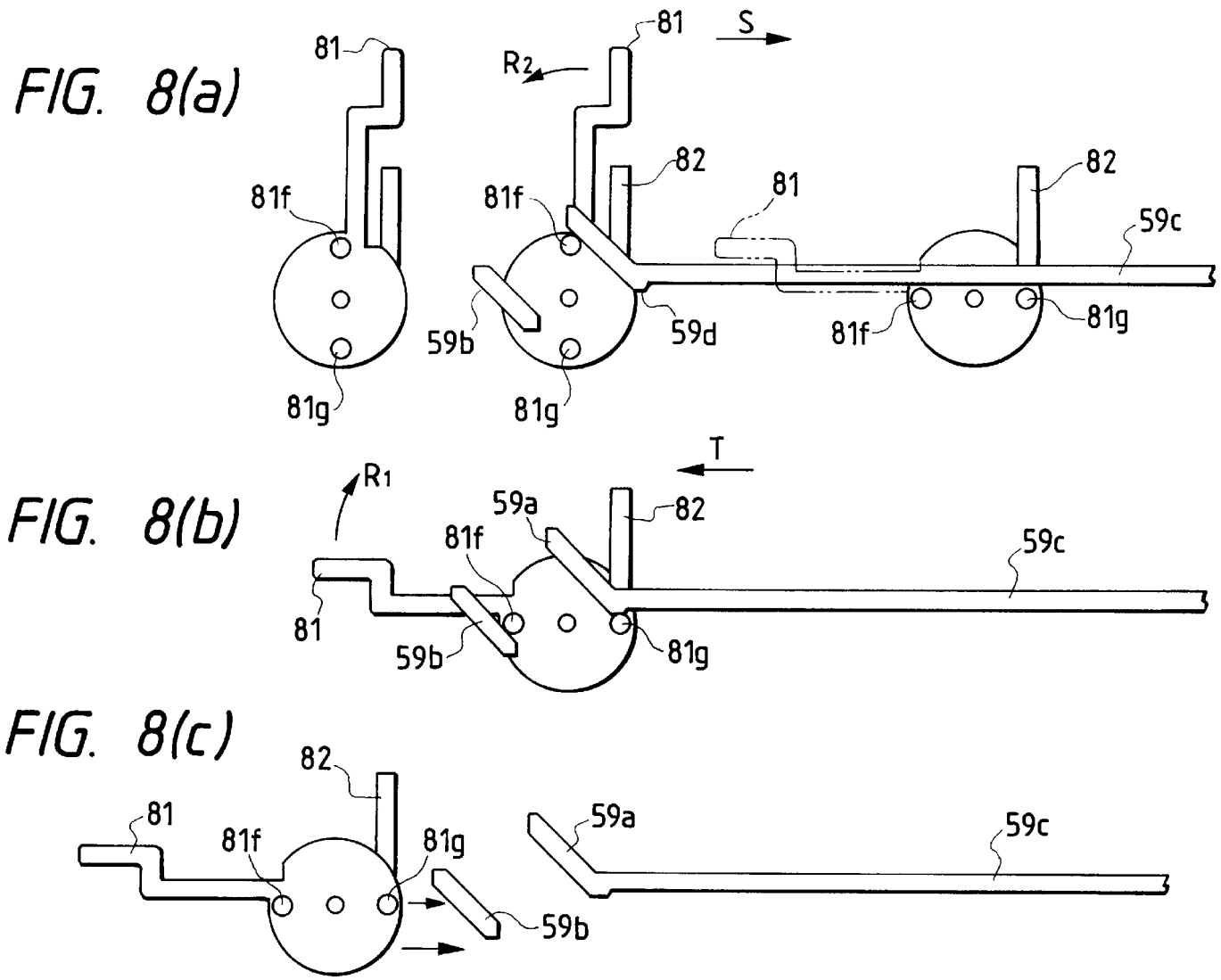
FIGS. 8(*a*), 8(*b*) and 8(*c*) are enlarged schematic elevational views of one supporting portion and the switch operating in accordance with the invention.

Referring to FIGS. 7 and 8, when slidable support assembly 80 is positioned within range B2 and is moved from the position shown by line B5 toward range B1 in the direction of arrow S, upper pin 81*f* passes above the second plate 59*b* and abuts against first plate 59*a* (see FIG. 8(*a*)), thereby causing first support member 81 to rotate counterclockwise in the direction of arrow R2 against the force of spring 83. At the time upper pin 81*f* climbs over protrusion 59*b*, first support member 81 is rotated to its maximum prone position, and as stated above, lower portion 81*b* of first support member 81 abuts against the lower face of left protruding portion 84*a*1 of detent portion 84*a*, such that support member 81 is lightly braced in the prone position. If a force is applied in the clockwise direction R1 to first support member 81, it is kept in the prone position by upper pin 81*f*, abuts against the lower face of rail 59*c*.

Conversely as shown in FIG. 8(*b*), when slider 84 moves in the direction of arrow T towards B5, upper pin 81*f* passes under plate 59*a* and abuts against second plate 59*b*, and support assembly 80 moves from range B1, where support is not required, to range B2, where support is required. At this point, upper pin 81*f* no longer abuts the lower face of rail 59*c*, and support member 81 rotates clockwise in the direction of arrow R1 to the upright position. Thus, first support member 81 automatically becomes prone or upright as left support assembly 80 is moved from side to side. As will be described later, as shown in FIG. 8(*c*), first support member 81 may be manually placed in the fallen position when it is situated to the left of plate 59*b* as viewed in FIG. 7.

As shown in FIG. 5, second support member 82 includes an upright piece, which is integrally formed with slider 84 and has a support face 82*a* that slopes downward in the downstream direction of the sheet feed path and supports sheets discharged from the pairs of discharge rollers 71 and 72. As shown in FIG. 7, first support member 81 is crank-like in form, such that when it is in the upright condition, its upper portion 81*c* is located above second support member 82. Therefore, discharged sheets are supported by first support member 81 when the first support member 81 is in an upright position, as shown in FIG. 8(*a*), and is supported by second support member 82 when first support member 81 is in the fallen position, as shown by FIG. 8(*b*).

Figure 9:
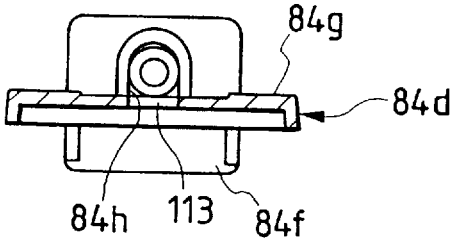
FIG. 9 is a sectional view taken along line 9—9 of FIG. 5.

As depicted in FIGS. 5 and 9, slider 84 is slidably mounted to lower portion frame 12. Slider 84 includes a base portion 84*d* in the rear portion thereof, fitting portion 84*e* which is slidably mounted onto bent portion 12*a* in the front portion of lower portion frame 12, and a leg portion 84*f* formed in base portion 84*d* and guided by the top surface 12*b* of lower portion frame 12. Slider 84 is slidably supported with respect to lower portion frame 12 by fitting portions 84*e* and leg portion 84*f*. An upper surface 84*g* of base portion 84*d* is slidably supported by the lower surface of a front plate 55 of regulating member 50.

Sliding support assembly 80 is operatively linked to edge guide 23 of automatic sheet feeder apparatus 20 by a linking mechanism. The linking mechanism includes a linkage rod 110. A first pinion 111 is integrally formed at one end (support assembly side) of linkage rod 110. A second pinion 112 (FIG. 1) is integrally formed at a second end (edge guide side) of linkage rod 110. A first rack 56 is formed on a lower surface of hanging piece 57 of regulating member 50 and engages with first pinion 111. A second rack 16*f* (FIG. 1) is formed in the rear portion of lower surface 16*a* of sub frame 16 and engages with second pinion 112.

As shown in FIGS. 5 and 9, a linkage rod leading edge 113, which is the front portion of first pinion 111, is rotatably supported in a shaft reception hole 84*h* formed in base portion 84*d* of slider 84. That is, a rear portion 114 of first pinion 111 is rotatably supported by a rear portion upper surface 84*i* of base portion 84*d* and a lower surface 58*a* of hanging piece 58 of regulating member 50. The rear portion 114 of first pinion 111 is slideable with respect to lower surface 58*a* of hanging piece 58 of regulating member 50 in a direction perpendicular to the sheet feed direction.

Figure 10:
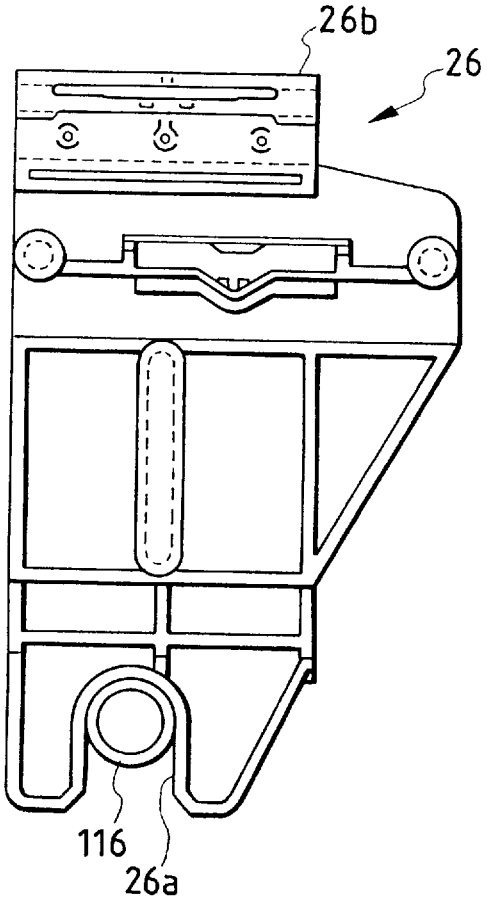
FIG. 10 is a rear elevational view of a connection plate constructed in accordance with the present invention.

As further shown in FIG. 1, a trailing edge 115 of linkage rod 110 is rollably supported by a lower portion of a bent portion 16*g* of back plate 16*b*. Trailing edge 115 of linkage rod 110 is movable by the engaging force of second pinion 112 and second rack 16*f*. Next, as shown in detail in FIG. 10, a recess portion 26*a* is formed in a lower portion of connecting plate 26. A rear portion 116 of second pinion 112 is rotatably supported within recess portion 26*a*.

In this way, the rear portion of linkage rod 110 is rotatably connected to edge guide 23. Specifically, upper portion 26*b* of connecting plate 26 is coupled to edge guide 23 and moves together therewith. Therefore, when a sheet is set in automatic sheet feeder apparatus 20 and edge guide 23 is moved in a direction perpendicular to the sheet feed direction, the movement of edge guide 23 is translated to second rack 161 through the above-described linkage. In turn, second rack 16*f* engages with second pinion 112 of linkage rod 110, thereby causing linkage rod 110 and first pinion 111 to rotate. Finally, first pinion 111 engages with first rack 58. In this manner, the leading edge 113 of linkage rod 110 does not receive any influence from the bending of linkage rod 110. That is, leading edge 113 moves essentially the same distance as trailing edge 115, and slider 84 and left support assembly 80 moves the same distance as edge guide 23 (shown in chain line in FIG. 2). Accordingly, when edge guide 23 is slid, left support assembly 80 is slid; that is, edge guide 23 and support assembly 80 are properly aligned by one operation—moving edge guide 23.

When left support assembly 80 passes by switch 59 during its movement, first support member 81 is automatically placed in the prone or upright condition. As stated above, discharged sheets are supported by first support member 81 while first support member 81 is in the upright position as shown by the solid line of FIG. 7 and is supported by second support member 82 while first support member 81 is in the prone position, as shown by the chain line thereof Whether the support edge of the discharged sheet is supported by first support member 81 or second support member 82 is determined selectively in accordance with the width of the sheet by manually setting edge guide 23 at an appropriate guide position.

According to this embodiment of the invention, the choice, that is, the position of switch 59 (the aforementioned boundary position C) is set between a position where a sheet of B5 is placed vertically and a position where a postcard is placed horizontally. In FIG. 7, a chain line indicated with "B5" denotes the position of surface 81*d* of first support member 81 when a sheet of B5 is vertically set on sheet feed tray 24, whereas a chain line indicated with "postcard" denotes the position of supporting surface 81*d* of first support member 81 when a postcard is horizontally set on sheet feed tray 24. In other words, according to this embodiment, in the event that sheet feed tray 24 contains sheets of B5 size, and the user desires to replace it with a post card, when edge guide 23 is slid to a position that agrees with the size of the post card, first support member 81 automatically falls to the prone position to allow second support member 82 to support the discharged post card. As will be described later, moreover, first support member 81 may be manually placed in the prone position when, for example, envelopes exceeding B5 in size are printed upon. When a sheet of B5 size is printed, edge guide 23 is slid to the range B1 and support assembly 80 interlocked therewith simultaneously slides to the B1 range causing lower pin 81*g* of first support member 81 to abut against second plate 59*b*. In this way, first support member 81 automatically assumes an upright position.

According to this embodiment, a third plate (not shown) similar to second plate 59*b* is provided in a position corresponding to A4 sheet size. When edge guide 23 is slid so as to print on sheets of A4 size after printing an envelope that exceeds A4 size by manually placing first support member 81 in the prone position, left support assembly 80 and edge guide 23 simultaneously slide to the right, and lower pin 81*g* of first support member 81 abuts against the third plate, causing first support member 81 to automatically assume an upright position.

Figure 12:
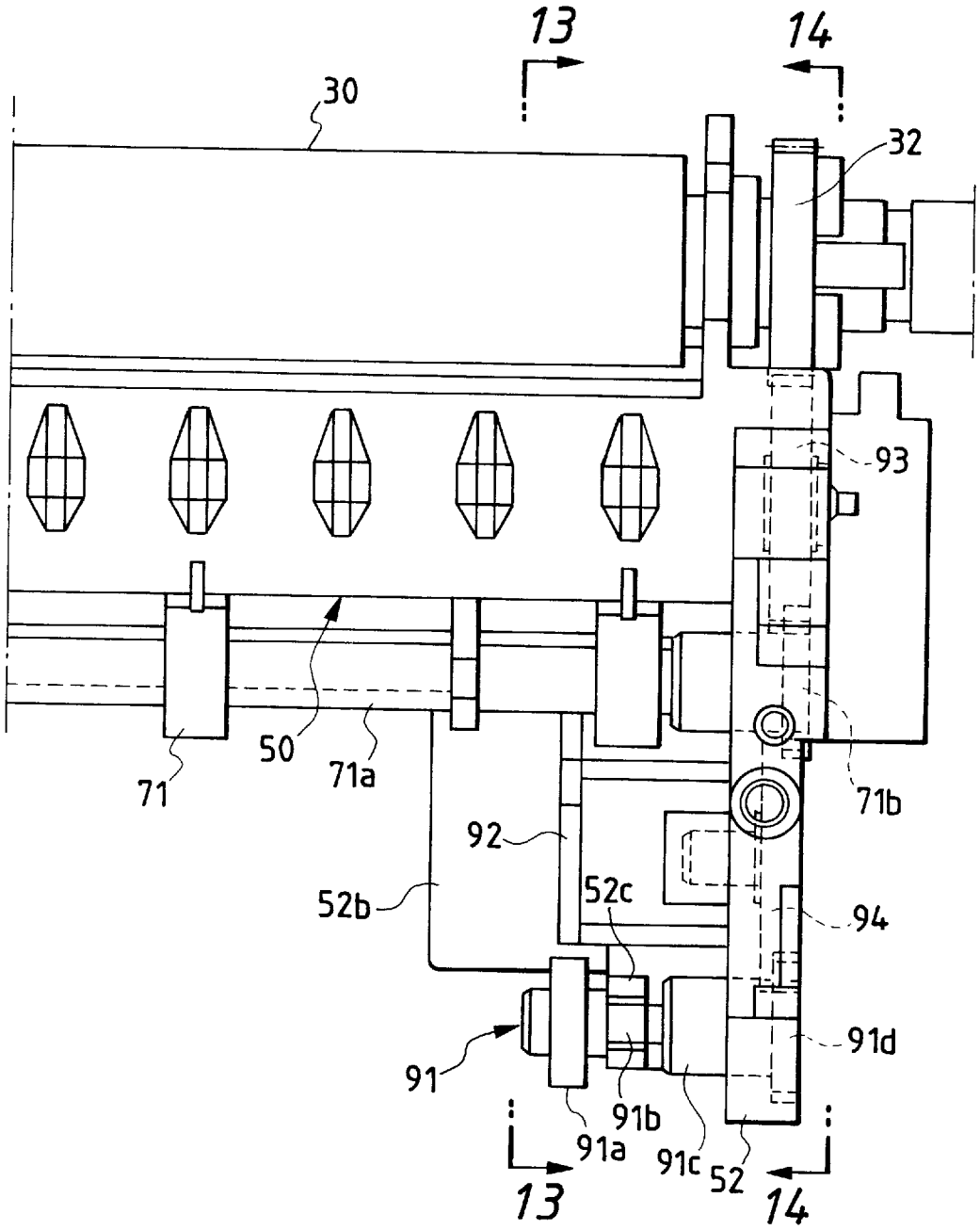
FIG. 12 is a partial enlarged top plan view of a portion of the printer constructed in accordance with the invention of FIG. 11A.

As shown in FIGS. 11–14, a second support assembly 90 for supporting a second edge of a sheet opposite the edge supported by the first support assembly 80, includes a driving roller 91 and a guide plate 92 for guiding the leading edge of a sheet to the driving roller 91. As is shown in FIG. 12, driving roller 91 includes a roller portion 91*a* for supporting discharged sheets from below, a small shaft portion 91*b*, a large shaft portion 91*c* and a roller gear 91*d* coupled to large shaft portion 91*c*. Driving roller 91 may be integrally formed of a synthetic resin. Roller portion 91*a* is preferably formed of a high friction coefficient material, such as rubber, to efficiently impart a driving force to discharging sheets. Small shaft portion 91*b* is rotatably supported by a support portion 52*c* formed integrally on a base portion 52*b*, which in turn is formed integrally with regulating member 50. Large shaft portion 91*c* is rotatably supported by a side plate 52 of regulating member 50. Driving roller 91 is thereby rotatably supported by small shaft portion 91*b* and large shaft portion 91*c* and driven to rotate by a gear train 110, generally shown in FIG. 14.

Figure 14:
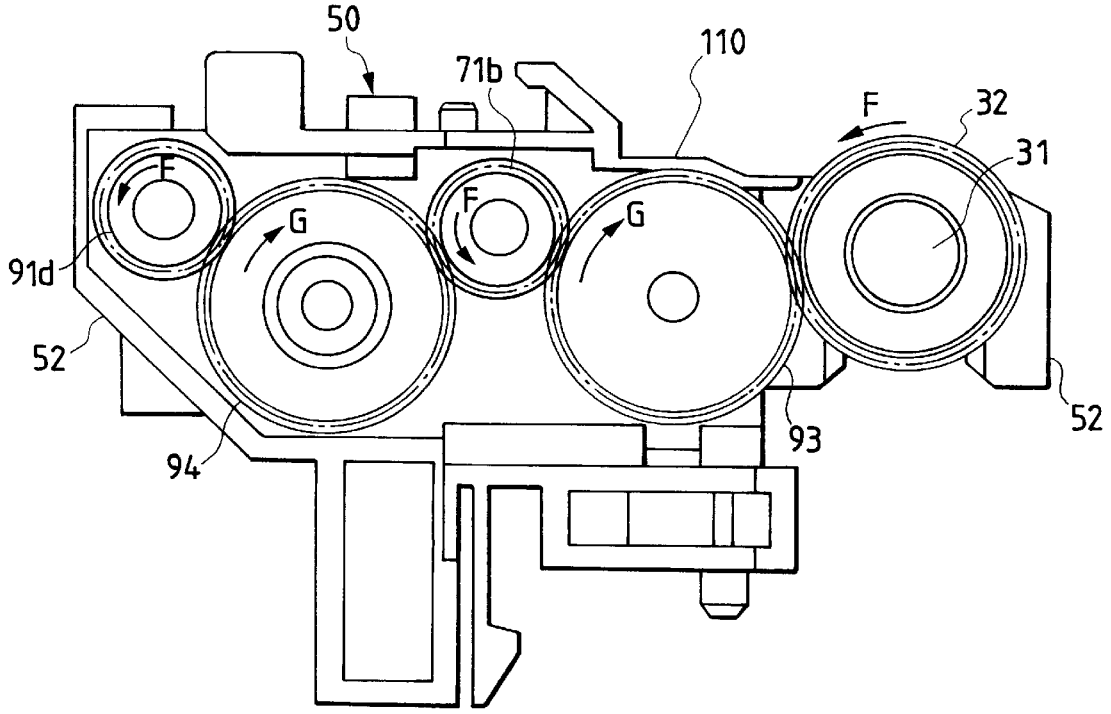
FIG. 14 is a sectional view taken along line 14—14 of FIG. 12.

Referring to FIG. 14, gear train 110 includes a sheet feed roller gear 32, which is mounted to shaft 31 of sheet feed roller 30, a sheet discharge gear 71*b*, which is mounted to shaft 71*a* of sheet discharge roller 71, first transmission gears 93, which meshes with sheet feed roller gear 32 and sheet discharge gear 71*b*, and second transmission 94, which meshes with sheet discharge gear 71*b* and roller gear 91*d*. When sheet feed roller shaft 31 is driven by drive mechanism 100 in the sheet-conveying direction, depicted by arrows F, sheet feed roller gear 32 also rotates in the sheet-conveying direction and causes first transmission gear 93 to rotate in the direction opposite to the direction of the sheet feed roller gear 32 depicted by arrows G. First transmission gear 93 drives sheet discharge gear 71*b* in the sheet-conveying direction, which drives second transmission gear 94 in the direction opposite to the direction of the sheet feed roller gear 32. Finally, second transmission gear 94 drives roller gear 91*d*, which, as it is attached to roller portion 91*a*, causes roller portion 91*a* to rotate in the sheet-conveying direction.

Figure 13:
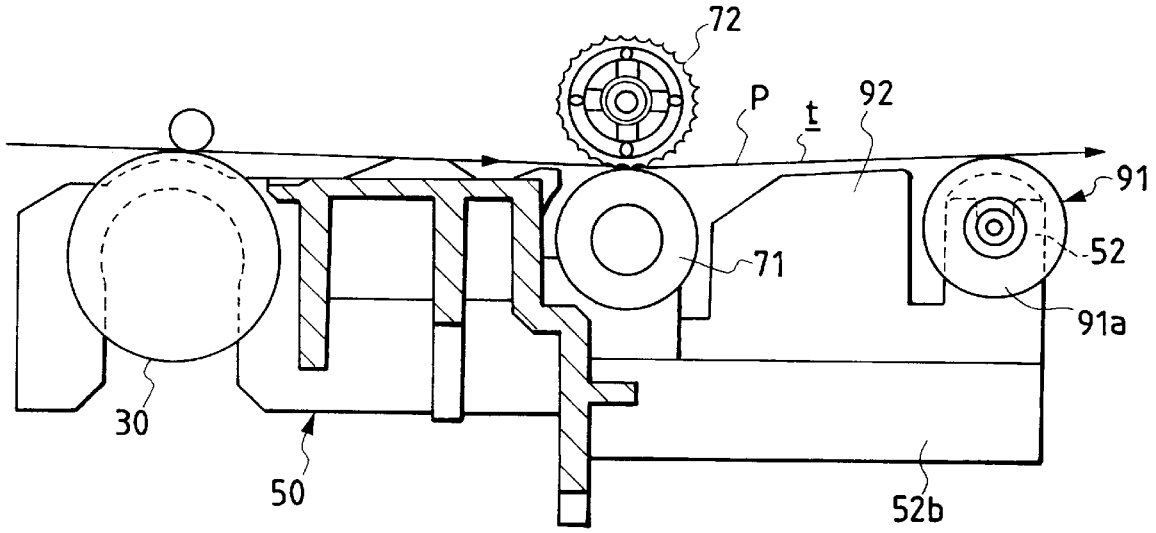
FIG. 13 is a sectional view taken along line 13—13 of FIG. 12.

As sheet P is discharged from sheet discharge rollers 71 and 72, guide plate 92 guides the leading edge of sheet P to roller portion 91*a* of driving roller 91. As shown in FIG. 13, guide plate 92 is positioned such that it is slightly lower than a line t connecting the upper surface of discharge roller 71 and the upper surface of roller portion 91*a*. Consequently, guide plate 92 provides little resistance to discharging sheets.

Figure 27:
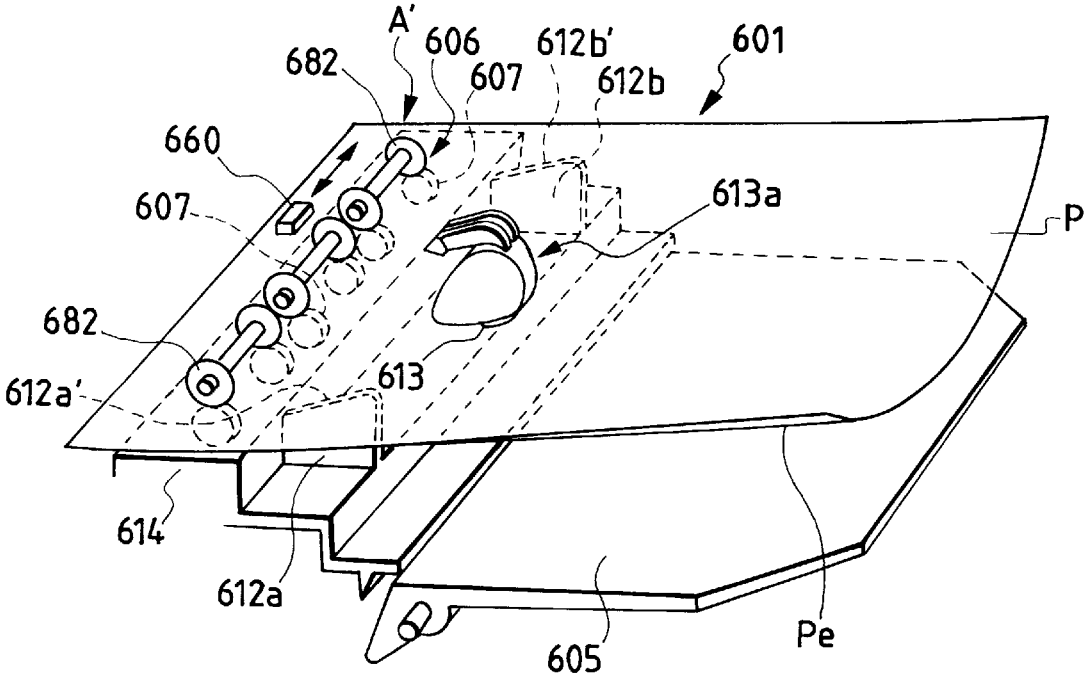
FIG. 27 PRIOR ART
FIGS. 27–31 depict printers constructed in accordance with the prior art.
Figure 31:
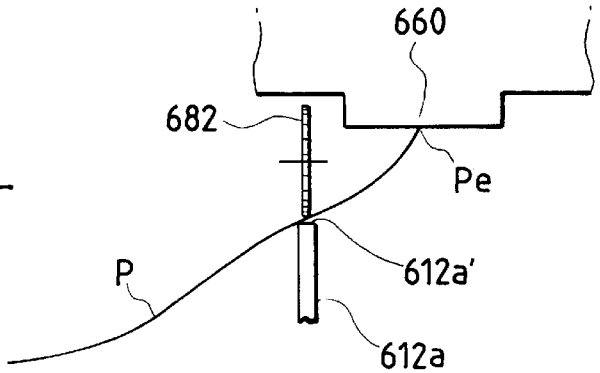
FIG. 31 PRIOR ART
Figure 30:
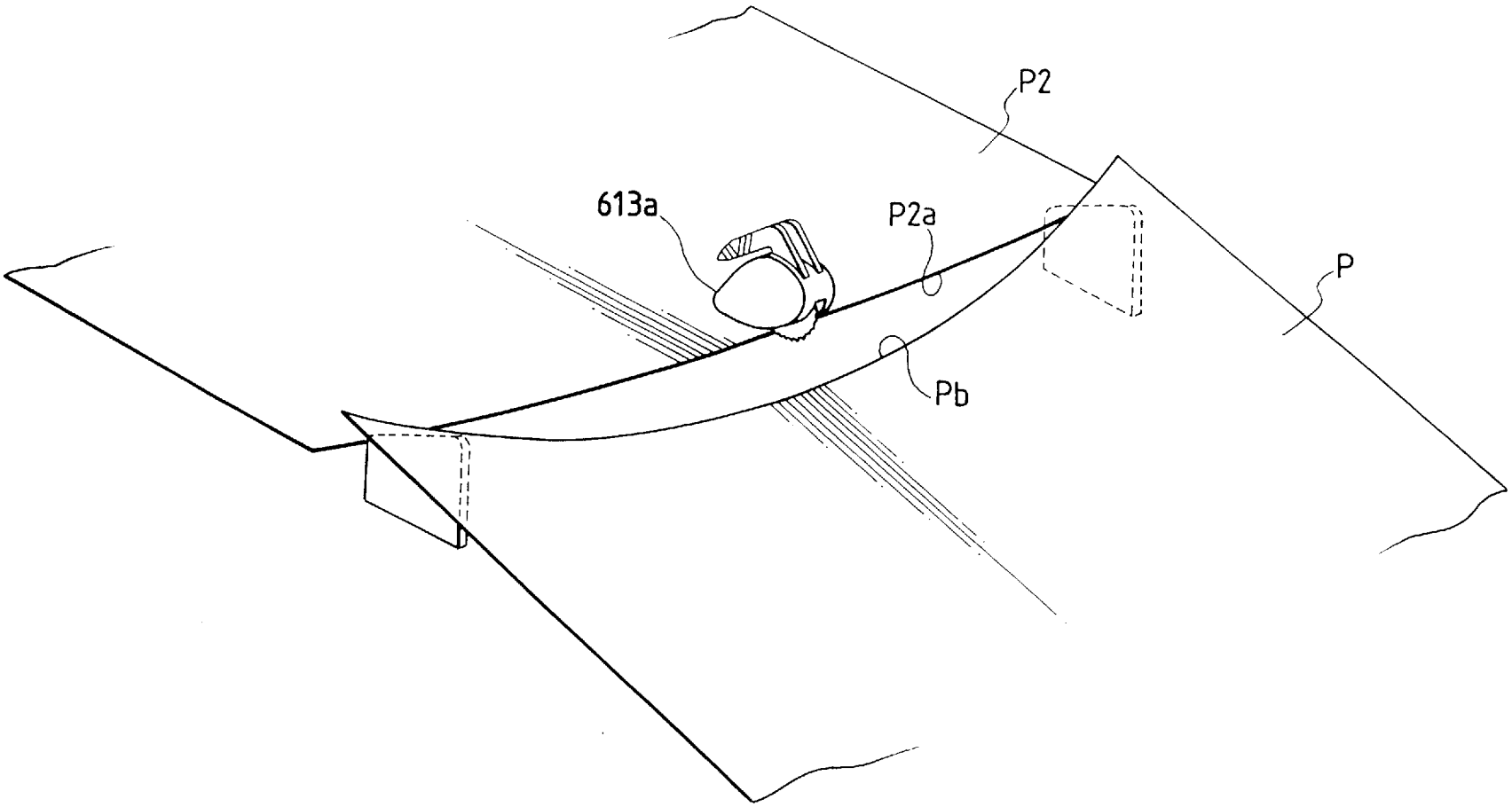
FIG. 30 PRIOR ART

In the conventional printer shown in FIG. 27, supporting surface 612*a*' is formed so that, as shown in FIG. 31, it is located at the same position in the sheetwidth direction as that of serrated roller 682, and makes contact with a portion of the bottom surface of sheet P. Thus, the side edge of sheet P is allowed to bend to a raised position and sheet P tends to become soiled by contact with print head 660.

By contrast, according to an embodiment of this invention shown in FIG. 11, roller portion 91*a* is located out of line with (inward of) outside sheet discharge roller 72' in the sheetwidth direction. Thus, rather than sheet P curling up towards the print head, the side edge of sheet P is held down by sheet discharge roller 72', and is prevented from becoming soiled by contact with print head 60.

Moreover, the problem of soiling the side edge of sheet P has also occurred in conventional printers on the left side edge of sheet P. Therefore, according to this embodiment of the invention, the same arrangement as mentioned above is applied to the position of the first support member 81 in the supporting portion 80 for supporting the left side portion of a sheet. Specifically, as is shown in FIG. 2, the left side edge of a sheet of A4 size is represented by line A4*e*, and chain line A4 represents upper edge face 81*d* of support member 81. Similarly, the left side edge of a sheet of B5 size is represented by line B5*e*, and chain line B5 represents upper edge face 81*d* of support member 81. As is apparent from FIG. 2, upper edge face 81*d* is situated slightly inward in relation to sheet discharge roller 72A4 for pressing down the left side edge of sheet P when characters are printed on A4-size sheets. Likewise, upper edge face 81*d* is situated slightly inward in relation to sheet discharge roller 72B5 for pressing down the left side edge of sheet P when characters are printed on B5-size sheets. In this manner, the left side edge of sheet P is prevented from becoming soiled by contact with print head 60.

Incidentally, as is shown at the top of FIG. 2, this embodiment is capable of accepting sheets over a width represented by M. Furthermore, although A4 is the maximum size sheet on which characters are printable over the whole width, B4 sheets also may be conveyed into width M for printing purposes. As such, left support assembly 80 may be positioned at the leftmost end of the printer face (the position where support assembly 80 is depicted in the solid line) beyond width M. The left-side edge of sheet P is not soiled, however, because print head 60 cannot reach that position.

Reference is made to FIG. 5. Holder 19*a* is mounted and rotatably supported within discharge portion 120 to support plate 53. Holder 19*a* includes guide blade 19*b* and serrated roller 19 rotatably mounted in holder 19*a*. As sheet P is discharged by pairs of discharge rollers 71 and 72, the leading edge Pf abuts guide blade 19*b*. The force of sheet P against guide blade 19*b* causes holder 19*a* to rotate in the direction indicated by arrow Y. Leading edge Pf of sheet P is urged downwardly by guide blade 19*b* and is guided by serrated roller 19 through discharge portion 120.

An ink-jet printer of this embodiment has the following function and effect.

First, the size of sheet used in the printer is set where sheet P is fed into the printer, at hopper 22 and sheet feed tray 24. Thus, by setting the sheet size, the user automatically ensures that the sheet is properly supported when it is discharged. That is, when the user varies the sheet size from A4 to B5, for example, and slides side plate 23*d* of edge guide 23 to abut against the edge of the sheet, the interlocking mechanism operates such that support portion 80 of discharge portion 120 slides into a position to provide proper sheet discharge support.

Second, when the printer operation is started, automatic sheet supply unit 20 feeds sheets through sheet channel PP. When sheet P reaches sheet feed rollers 30, it is fed out of sheet feed rollers 30 at a feed angle defined by pinch rollers 40. Because pinch rollers 40 automatically align to contact properly sheet feed rollers 30, sheet P is prevented from moving obliquely.

Figure 4:
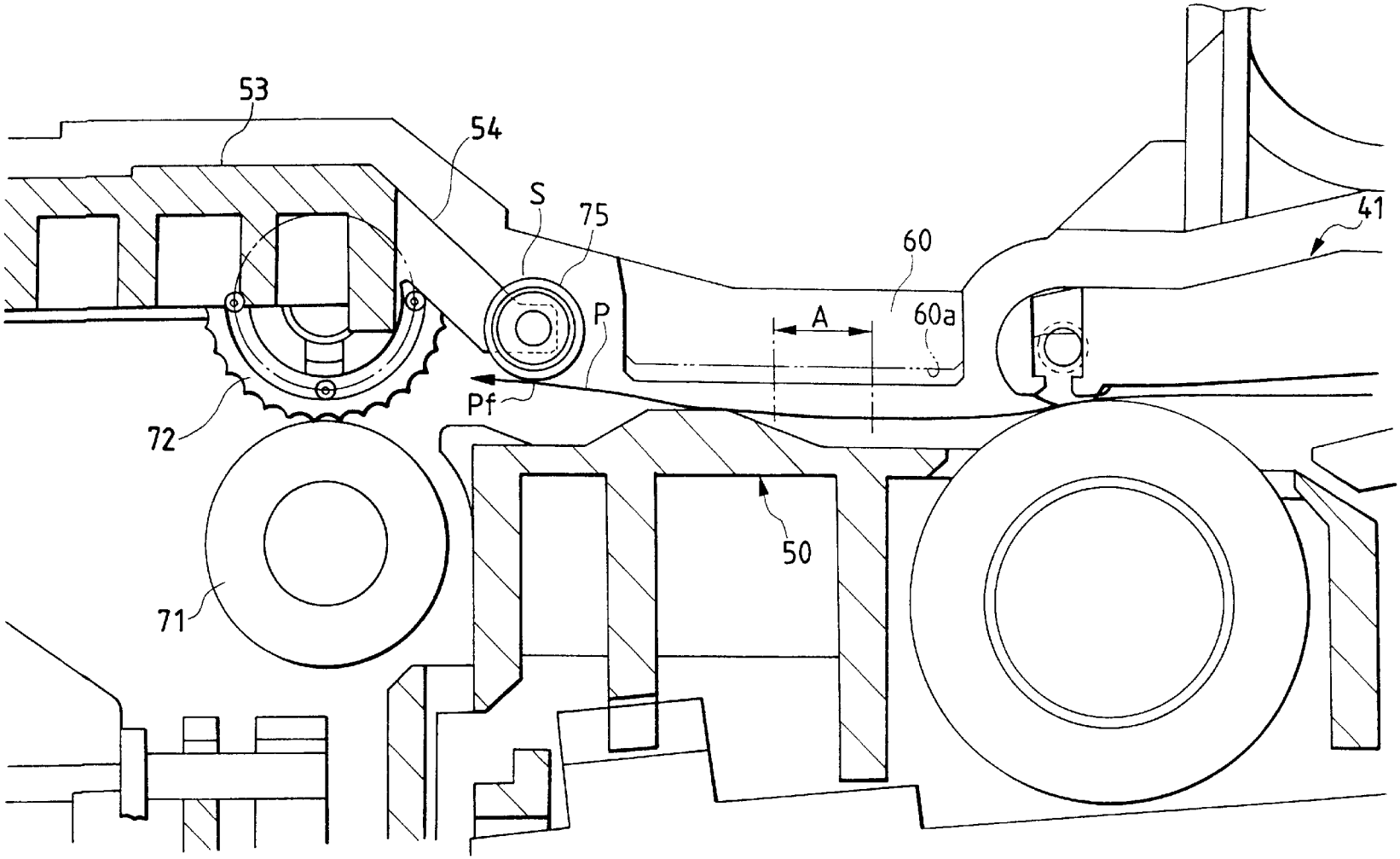
FIG. 4 is an enlarged sectional view of a portion of the ink jet printer constructed in accordance with the invention.

Third, as shown in FIG. 3, the leading edge of sheet P fed by sheet feed rollers 30 are guided and urged upwardly by slanting surface 51*b* of regulating member 50, while the gap between the surface of the sheet and print head 60 is regulated by the bottom surface Pb of sheet P abutting the top surface 51*a* of rib 51. After the top front surface Pa of sheet P is printed upon by ink being discharged from head 60, the leading edge Pf of sheet P moves towards discharge rollers 71 and 72. Sheet P may be badly warped at this stage of printing, and, therefore, as shown in FIG. 4, guide roller 75 is provided between print head 60 and the pair of discharge rollers 71 and 72 to more precisely redirect sheet P toward pairs of discharge rollers 71 and 72. That is, even if sheet P is warped, leading edge Pf of the sheet is prevented from entering space S between print head 60 and the pair of discharge rollers 71 and 72. Therefore, sheet P does not contact print head 60 and sheet jamming does not occur.

Furthermore, when thick sheets, such as postcards or envelopes, are to be printed upon, the position of print head 60 is positioned upwardly as depicted by the chain line in FIG. 4. In this situation, because the gap between the lower surface 60*a* (nozzle aperture surface, i.e. ink discharge surface) of print head 60 and regulating member 50 becomes larger, there is a tendency for the leading edge Pf of the sheet to enter more readily space S between print head 60 and the pair of discharge rollers 71 and 72. However, the leading edge Pf of sheet P is reliably prevented from entering space S between print head 60 and the pairs of discharge rollers 71 and 72 by guide roller 75.

Moreover, because sheet feed path PP is a curved sheet feed path, the size of the printer can be made smaller than a printer having a straight sheet feed path. That is, by making sheet feed path PP curved, the tendency for the leading edge Pf of sheet P to easily enter space S between print head 60 and the pair of discharge rollers 71 and 72 is encouraged, but in this embodiment, sheet P is reliably directed towards the pair of discharge rollers 71 and 72 by guide roller 75.

Additionally, because the rear surface Pb of conveyed sheet P abuts ribs 51 of regulating member 50, the gap between print head 60 and sheet P is regulated and printing is carried out without the possibility that sheet jamming will occur. Further, since ribs 51 are elongated when viewed in the sheet conveying direction, they do not disturb the conveyance of the sheets. Because the plurality of ribs 51 are formed in a direction perpendicular to the direction of sheet conveyance, even if high density ink dots are formed on sheet P and the sheet wrinkles due to the ink moisture content, ribs 51 accommodate the swelling of the sheet into the spaces 51*s* between adjacent ribs 51 (see FIG. 15(*c*)). Because of this construction, even if sheet P wrinkles, the sheet does not abut print head 60 and ink smudging does not occur.

Figure 15A:
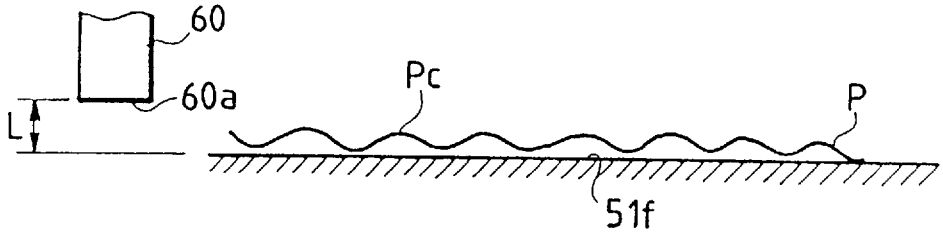
FIG. 15(a) PRIOR ART
FIGS. 15(*a*) and 15(*b*) are schematic views of a warped sheet passing beneath the printing section in accordance with the prior art.
Figure 15B:
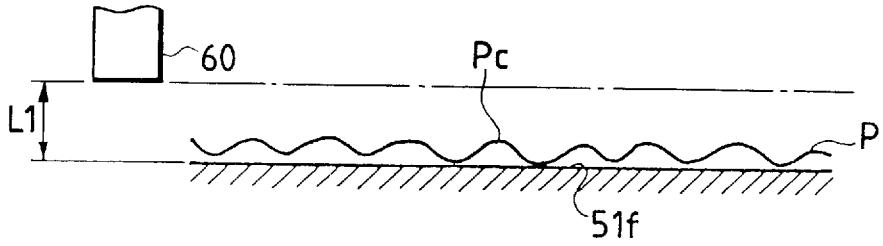
FIG. 15(b) PRIOR ART
Figure 15C:
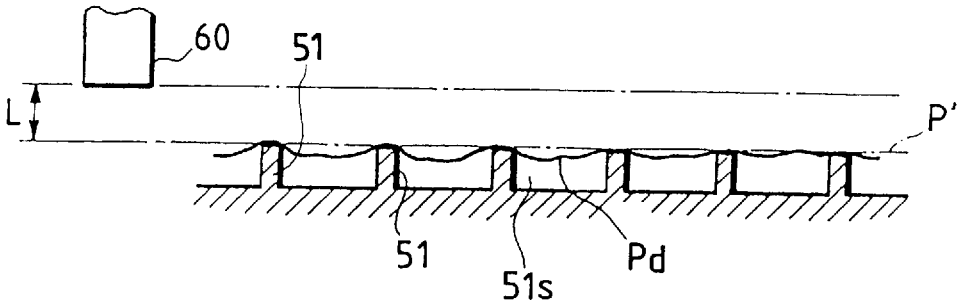

More particularly, as depicted in FIGS. 15(*a*)–15(*c*), the distance L is the ideal gap distance between print head 60 and a sheet of sheet P that has not wrinkled. Sheet P moves across flat surface 51*f* of regulating member 50. Where the gap between sheet P and print head 60 is the ideal gap L, when sheet P wrinkles due to the ink moisture content thereon, the protruding portions Pc of wrinkled sheet P and the ink discharge surface 60*a* of print head 60 will contact each other.

One contemplated method to solve this problem, as shown in FIG. 15(*b*) is to provide a gap L1 between flat surface 51*f* and print head 60 that is larger than the aforementioned gap L. As gap L1 is made larger, however, if the sheet is not wrinkled and as such is in a flat condition, the distance between the sheet guided by flat surface 51*f* and the print head 60 (that is, roughly the distance L1) is too large and, therefore, the ideal printing gap cannot be obtained. If the distance the ink drops discharged from print head 60 must travel to strike the surface of the sheet is too large, the margin for error between the ideal striking point and the actual striking point on the sheet increases.

To overcome this problem, extending ribs 51 extend from surface 51 as depicted in FIG. 15(*c*). In the situation where the ink density is comparatively small, that is, where the sheet does not wrinkle, sheet P' is in a flat condition and is guided by the upper surface of ribs 51 and the distance between the sheet P' and print head 60 can be set at the aforementioned ideal distance L. In the case where ink dots are formed on the sheet at high density and the sheet wrinkles due to the ink moisture content therein, the sheet may swell causing trough portions Pd. These trough portions Pd are accommodated into the spaces 51*s* between adjacent ribs 51. Therefore, even if sheet P' wrinkles, the protruding portions Pc (FIG. 15(*b*)) will not abut print head 60 thereby reducing the possibility of ink smudging.

Figure 16A:
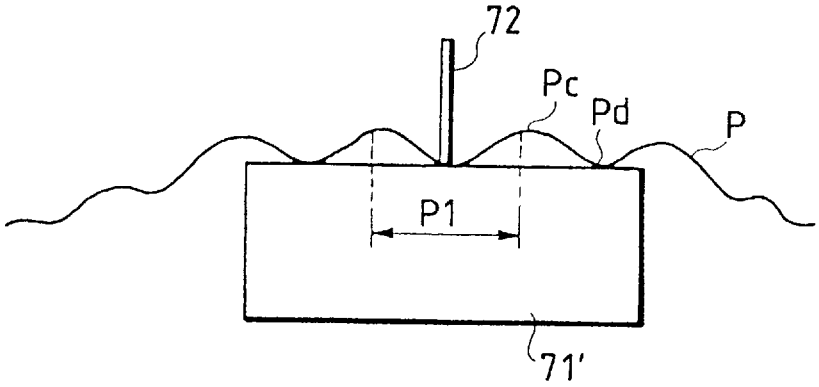
FIGS. 16(*a*) and 16(*b*) are schematic views showing operation of various sheet discharge rollers.
Figure 16B:
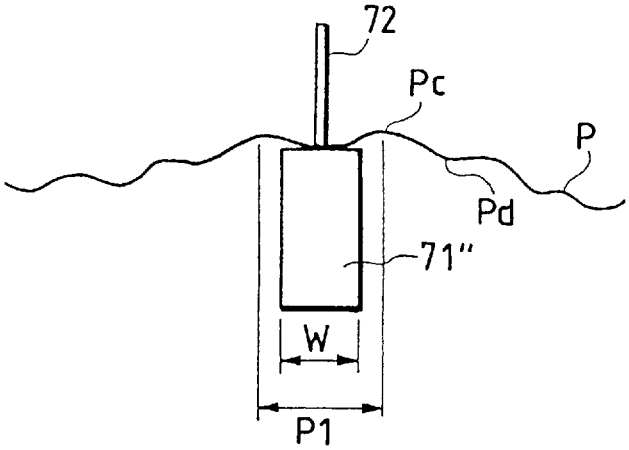

Reference is now made to FIGS. 16(*a*) and 16(*b*). Among each roller 71 of the pairs of rollers 71 and 72, it is preferable that downwardly extending rubber roller 71 is not a long, round, rod-shaped roller (such as roller 71'), but rather a plurality of narrow rollers arranged along the width of the sheet path. If rollers 71 are narrow in width, even if, for example, a high ink moisture content causes sheet P to wrinkle and swell and create trough portions Pd, the sheet will feed much more effectively if the trough portions Pd can hang over the edges of rollers 71. For example and as illustrated in FIG. 16(*b*), it is desirable that the width of rubber rollers 71 be set as small as possible within a range that still permits accurate and reliable sheet conveyance. An example of a preferably narrow roller is depicted in FIG. 16(*b*) as roller 71". The width W of the rubber roller 71" is narrower than the wave pitch PI of the wrinkled sheet. In a preferred embodiment, the width of roller 71" is approximately 5 mm. With this construction, the trough portions Pd of wrinkled sheet P can hang over the edges of roller 71 ". On the other hand, it is undesirable to have the roller construction depicted in FIG. 16(*a*), which illustrates a long roller 71'. In this situation, the trough portion Pd of the wrinkled sheet P will rest on roller 71'. Therefore, even if serrated roller 72 attempts to urge sheet P downward, protruding portion Pc will remain in a raised condition.

Another advantage of the present invention, is that when sheet P contacts pairs of discharge rollers 71 and 72, sheet P is placed in a taut condition between sheet feed rollers 30 and the pairs of discharge rollers 71 and 72 because of the aforementioned rotational speed differential between rollers 71 and 72 and sheet feed rollers 30. When high density ink dots are formed on sheet P, even if the sheet wrinkles due to the ink moisture content, the swelling of the sheet is reduced due to the tension force within sheet P and a more reliable printing operation is achieved. Yet further, as regulating member 50 urges sheet P towards the print head side and abuts the rear surface Pb of sheet P, the swelling of sheet P is positioned a sufficient distance away from head 60. Because of this, even if the sheet has wrinkled, the sheet does not contact print head 60 and the likelihood of ink smearing is greatly reduced. Moreover, in the above-mentioned fashion, as the swelling of the sheet is accommodated into the spaces 51*s* between adjacent ribs 51, the contacting of wrinkled sheet and print head 60 and subsequent ink smudging is more reliably prevented.

Figure 17A:
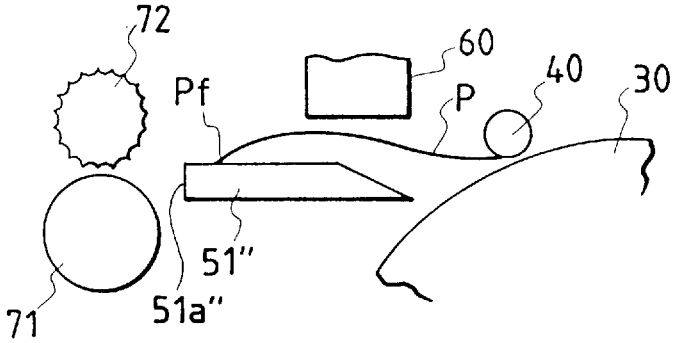
FIG. 17(a) PRIOR ART
FIG. 17(*a*) is a schematic view of a rib member constructed in accordance with the prior art.
Figure 17B:
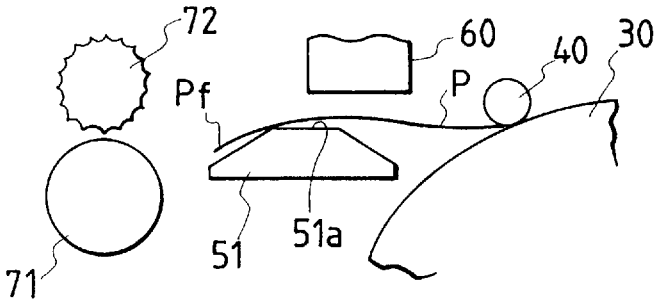

Reference is now made to FIGS. 17(*a*), 17(*b*) in connection with the following disclosure to highlight the following beneficial operational effects obtained by the construction of ribs 51 in a substantially trapezoidal shape. First, in a serial printer that prints single lines upon sequentially receiving printing data for single lines from a host computer, for example, it is necessary to be able to feed sheets in a reverse direction (that is, reverse feed), because the printing region of enlarged characters is larger than the printing region of standard characters. Therefore, as the sheet is fed in a reverse direction, the enlarged characters are printed by a method of divided printing with multiple passes, that is, by the head scanning and sheet feeding the length of the printing region A shown in FIG. 3. In this situation, it is necessary to feed sheets in a reverse direction to complete the printing of the enlarged characters. If ribs 51 did not have a trapezoidal shape when viewed from the side, but rather, for example, had a rectangular shape when viewed from the side (see FIG. 17(*a*), rib 51"), and there was an obstruction during the reverse feeding operation on the rear surface of a sheet (for example, an envelope flap), the edge of sheet P could become caught on the rib edge 51*a*" when reverse feeding occurred, a pitch defect would develop, and an inaccurate printing operation would occur. That is, the necessary line distance of reverse feeding and the amount of sheets fed immediately afterwards in a forward direction would be disrupted.

To overcome this problem, ribs 51 are preferably of a substantially trapezoidal shape when viewed from the side. Therefore, even if during a reverse feeding operation there is an obstruction such as a flap portion of an envelope, for example, the trapezoidal shape of the rib reduces any catching and consequently, pitch defects do not develop and a reliable sheet feed operation is assured.

Secondly, when printing is carried out near leading edge Pf of sheet P, the leading edge Pf may become curved. However, if ribs 51" are not trapezoidally shaped (as in FIG. 17(*a*), rib 51") the leading edge Pf of the sheet may rest upon the upper surface of ribs 51" leading up to the pairs of discharge rollers 71 and 72. The sheet P will be raised in the area of print head 60 and the possibility of ink smearing against print head 60 increases.

To overcome this problem, because the ribs 51 in the present embodiment have a substantially trapezoidal shape when viewed from the side (as shown in FIG. 17(*b*)) the leading edge Pf of sheet P soon moves away from the uppermost surface 51*a*, and as a consequence, the appearance of the sheet floating is reduced and the possibility of ink smudging against print head 60 is greatly reduced.

Moreover, regulating member 50 includes a guide portion 51*e* (FIG. 4) secured thereto for guiding the leading edge of sheet P towards pairs of discharge rollers 71 and 72. Guide portion 51*e* is preferably positioned upstream of discharge rollers 71 and 72 and downstream of ribs 51 (relative to a forward sheet conveying direction). Accordingly, even if ribs 51 were not formed with a substantially trapezoidal shape, the leading edge of sheet P can be more reliably guided towards pairs of discharge rollers 71 and 72. Thus, providing guide portion 51*e* upstream of pairs of discharge rollers 71 and 72 in the sheet conveyance direction and preferably not providing guide portion 51*e* in any other location, the leading edge of sheet P is reliably guided towards pairs of discharge rollers 71 and 72 and abutting and smudging of sheet P against print head 60 is more reliably prevented.

Moreover, when a plurality of colors of ink is discharged from print head 60 and color printing is performed, ink dots are formed on top of previously formed ink dots and the wrinkling in the sheet may become particularly severe. However, because of the advantageous construction disclosed above, the possibility of abutting and ink smudging of the wrinkled sheet P against print head 60 is greatly reduced.

Reference is once again made to FIGS. 5, 19 and 20. Holder 19*a* is mounted and rotatably supported within discharge portion 120. Holder 19*a* includes guide blade 19*b* and serrated roller 19 rotatably mounted in holder 19*a*. Additionally, first support member 81 and second support member 91 include respectively formed sloping faces 81*d* and 92 (see FIG. 2). First support member 81 is located in range B2 and as such is in the upright position. As sheet P of A4 size is discharged by pairs of discharge rollers 71 and 72, the leading edge Pf will abut guide blade 19*b*. The force of sheet P against blade 19*b* will cause holder 19*a* to rotate in the direction indicated by arrow Y (FIG. 5). However, the leading edge Pf of sheet P is urged downwardly by guide blade 19*b* and is guided by serrated roller 19 through discharge portion 120.

At the same time, both side portions of the sheet leading edge Pf are supported from below by sloping faces 81*d* of support portion 81 and roller portion 91*a* of driving roller 91. As sheet P is fed in the sheet-conveying direction, the edge supported by driving roller 91 is guided upward by support portion 92, while being driven by roller portion 91*a*. Consequently, as sheet P is gradually discharged, the leading edge Pf is urged into a hollow concave shape as shown in FIGS. 19 and 20.

Figure 19:
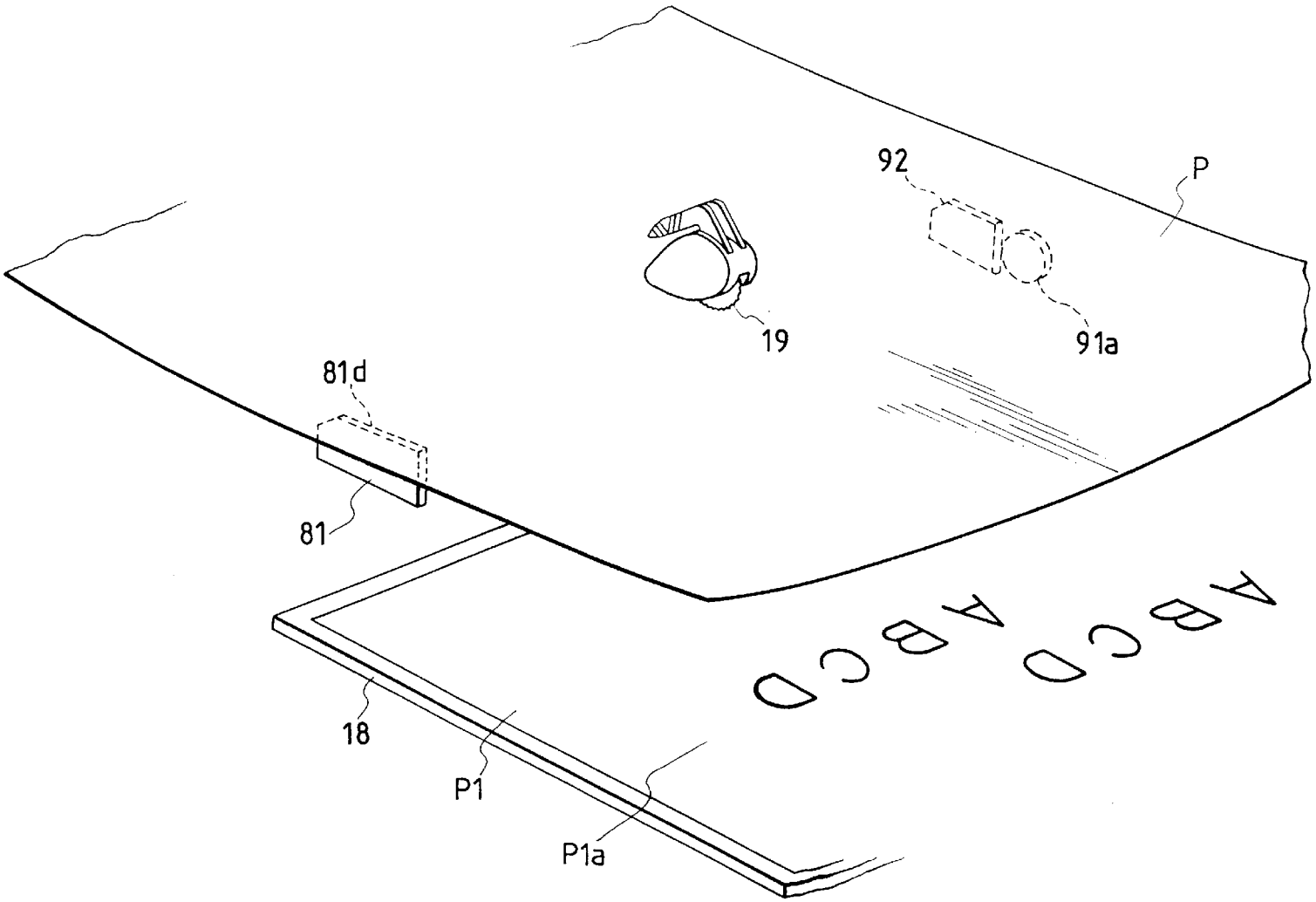
FIG. 19 is a perspective view of the sheet discharge section in accordance with the present invention.

FIG. 19 depicts sheet P being discharged while it engages sloping face 81*d*, roller portion 91*a* and serrated roller 19. When viewed in the discharging direction, as sheet P is forcibly urged into a hollow concave shape, the sheet becomes stiff, and it is fed in the discharging direction in what appears to be a floating state. Because of this, the time until discharged sheet P slidably contacts a printed surface P1*a* of previously printed and discharged stacked sheet P1 is delayed. This delay permits sufficient time for the ink of already printed sheet P1 to dry.

As sheet P is further transported in a discharging sheet direction, its trailing edge passes pairs of discharge rollers 71 and 72. The sheet P therefore loses its transporting force and the rear portion of the sheet is maintained in its concave state by means of discharge portion 120 and, specifically, by support portion 81 and driving roller 91, which imparts little driving force to ordinary sheets.

Figure 20:
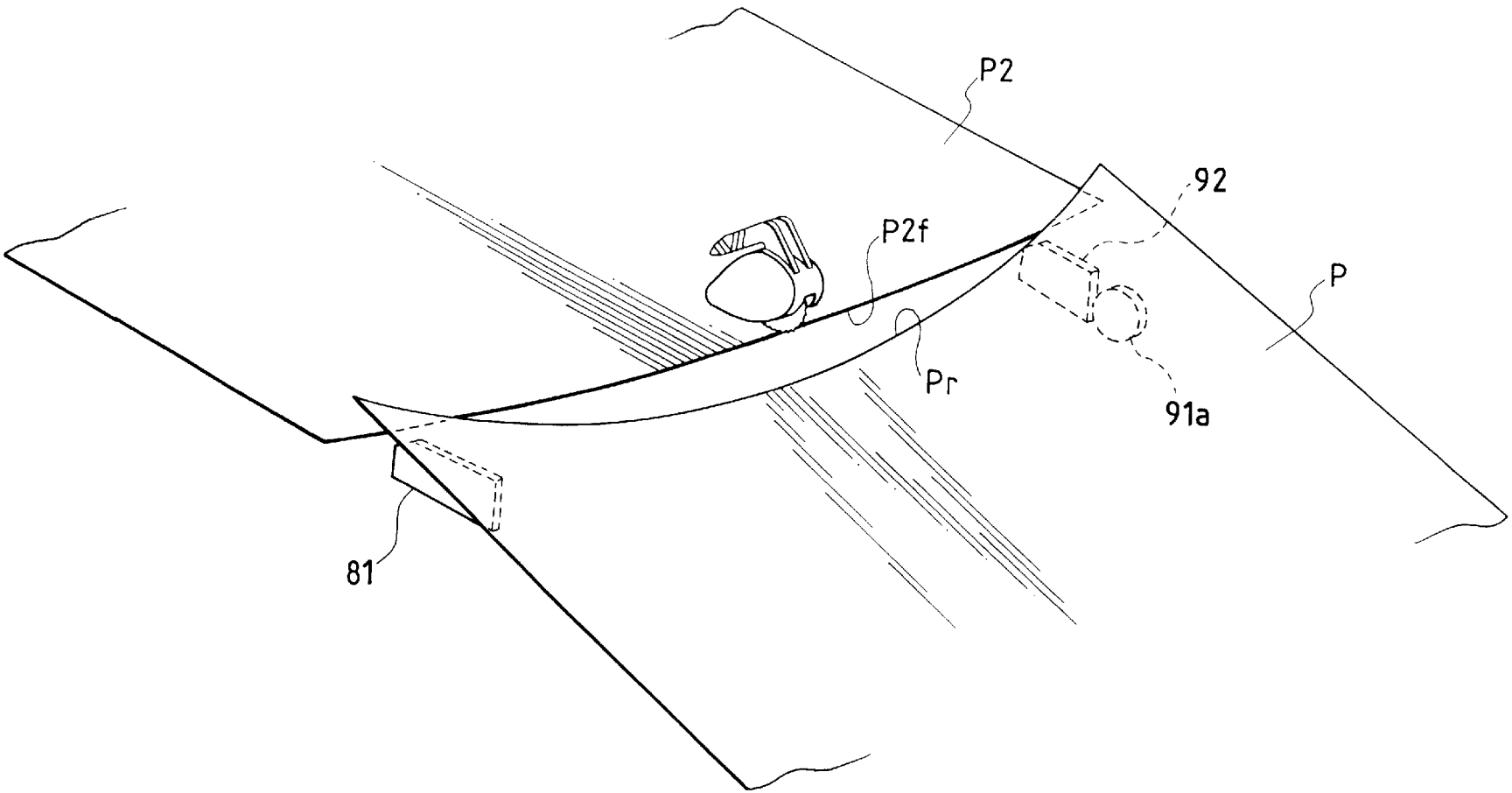
FIG. 20 is a perspective view of the sheet discharge section during a sheet discharge operation.

As shown in FIG. 20, as a subsequent sheet of sheet P2 is printed its leading edge P2*f* passes pairs of discharge rollers 71 and 72. The hold on the previous sheet P by discharge portion 120 is released when its trailing edge Pb is contacted by leading edge P2*f* of following sheet P2. As the hold on previous sheet P by discharge portion 120 is released, it is stacked on top of a previous already printed sheet (P1 in FIG. 19). However, by the advantageous construction of discharge portion 120, the time until sheet P contracts sheet P1 is further delayed and sufficient time has elapsed for the ink on sheet P1 to dry. The concavity of sheet P allows sheet P2 to easily and reliably contact the rear edge Pb of sheet P. If sheet P did not have any concavity, it would be very difficult to ensure that front edge P2*f* would contact rear edge Pb of sheet P.

After leading edge P2*f* of sheet P2 contacts trailing edge Pb of sheet P and contact of sheet P with support portion 81, roller portion 91*a* and serrated roller 19 is released, forward conveyance of sheet P2 is momentarily stopped. This stopping operation can be performed by the counting of pulses of the motor (not shown) that drives pairs of discharge rollers 71 and 72. When the desired number of pulses has reached the predetermined number, the motor drive mechanism can be restarted and sheet P2 can continue to be fed through discharge portion 120. By adopting a pushing-out method that includes momentarily stopping sheet P2 from being further discharged as sheet P is being stacked upon previous printed sheets, and where leading edge P2*f* of sheet P2 contacts trailing edge Pb of sheet P when sheet P is in a concave state, leading edge P2*f* of following sheet P2 and trailing edge Pb of previous sheet P can reliably engage each other and the sheet stacking operation (dropping operation) of sheet P on the previous already printed sheet P1 (see FIG. 19) becomes very reliable. Absent an operation where sheet P2 is momentarily stopped, the reliability of the stacking operation and the ability to ensure that the ink will have sufficient time to dry are diminished.

Figure 21:
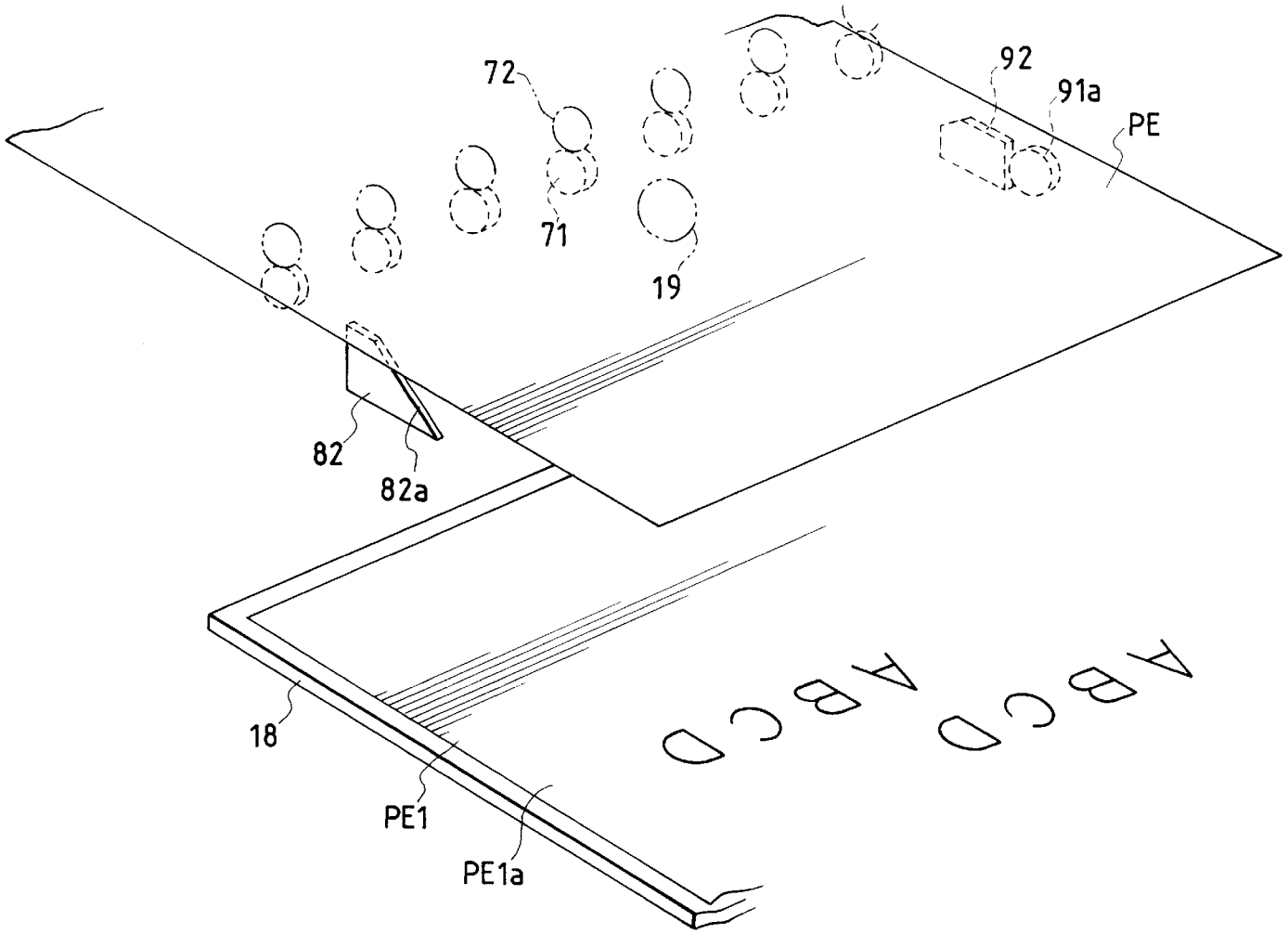
FIG. 21 is a perspective view of the sheet discharge section during sheet discharge operation.

When relatively stiff sheets of B5 size or smaller, such as envelopes, is used, as shown in FIG. 21, the curved condition of a relatively flexible sheet is not attained by supporting it with the pair of upward-tilted support face 81*d* and driving roller 91 because the stiffness of the sheet prevents it from assuming a concave configuration. To assure sheet feeding accuracy when relatively stiff sheet PE is guided by supporting surface 81*d*, the urging force of coil spring 73 and the pressure contact force against the discharge rollers 71 might be increased so as to increase the force with which sheet P is discharged. However, traces of ink may form on the surface of sheet P if the urging force of coil spring 73 is increased too much, thereby lowering the quality of printing. Where glossy sheets are used, such traces are particularly undesirable because they appear more conspicuously.

To overcome this problem, the downward force applied by holder 19*a* to sheet P is increased, and the weight acting on sheet P in contact with roller portion 91*a* of the driving roller 91 is increased by the weight of the sheet itself. Thus, a greater driven force is available from the driving roller 91 to the sheet to be discharged in comparison with the aforementioned ordinary sheets.

Further, as shown in FIG. 21, when first support member 81 of left support assembly 80 is manually placed in the prone position, second support member 82 is exposed and supports discharging sheet P. If stiff sheet PE was supported and guided by first support member 81, a resistance would build up between surface 81*d* and the sheet because surface 81*d* is tilted upward and is at a relatively high position. Thus, to prevent this situation, second support member 82 is used to support the sheet, as it does not contact or is in slight contact with sheet P, and driving roller 91 is used to support and drive the sheet.

In this configuration, sheet PE is discharged by pairs of sheet discharge rollers 71 and 72 and is supported in a substantially horizontal condition (in the floating condition) by pairs of discharge rollers 71 and 72, roller portion 91*a*, and the stiffness of sheet PE until the rear edge of sheet PE passes through pairs of sheet discharge rollers 71 and 72. Thus, the discharge of sheet PE and its subsequent stacking on previously discharged sheet PE1 is delayed to allow time for the ink to dry on sheet printing face PE1*a*.

Figure 22:
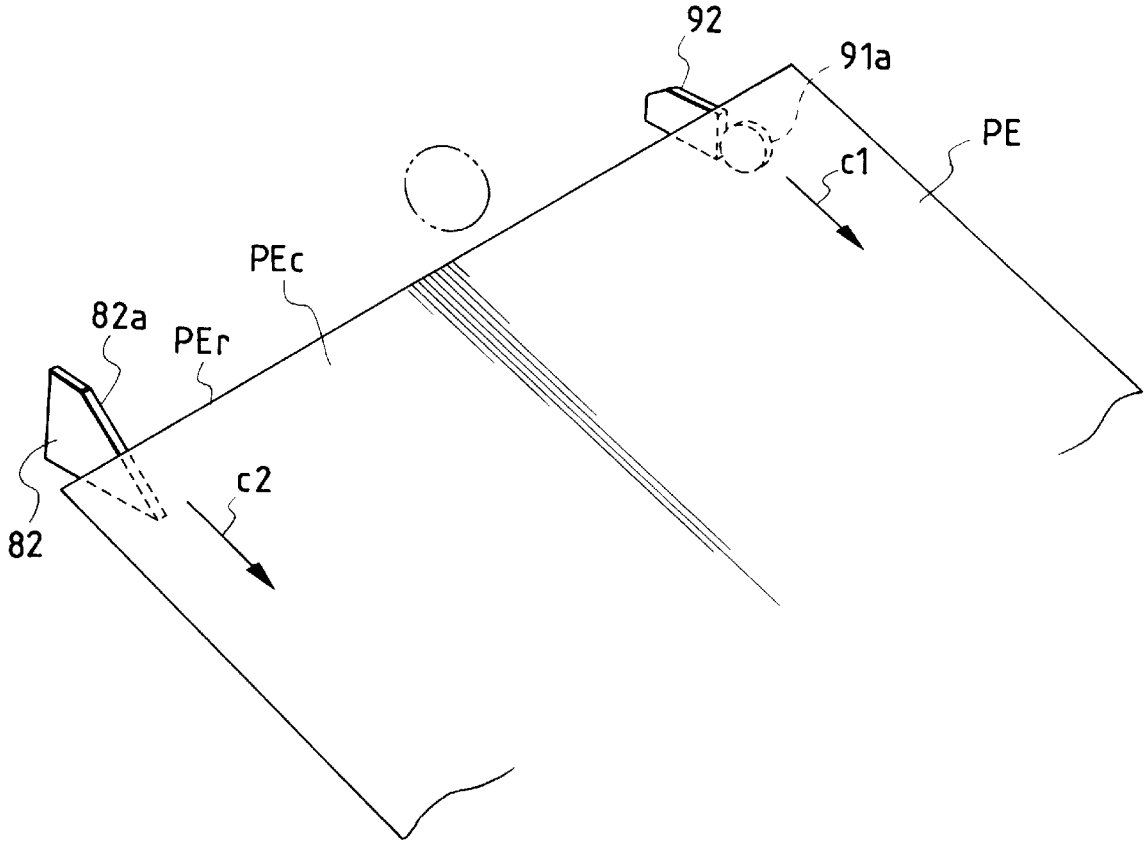
FIG. 22 is a perspective view of the sheet discharge section during sheet discharge operation.

When sheet PE is conveyed further and the rear edge PEr of sheet PE passes between the pairs of discharge rollers 71 and 72, the conveyance force is lost. As shown in FIG. 22, one side of the rear edge portion PEc of sheet PE is conveyed by the driving force of roller portion 91*a* as shown by arrow c1 and the other side thereof slips down the downward supporting surface 82*a* of the second support member 82 as shown by arrow c2. In this manner, sheet PE is stacked on previously printed sheet PE1 (see FIG. 21).

Although the aforementioned discharging action is available when first support member 81 of supporting portion 80 is manually placed in a prone position, it is not always convenient or desirable for the user to manually position first support member 81. Thus, when ordinary sheets of A4 or B5 size is printed, edge guide 23 is slid to the right and, as stated above, lower pin 81*g* of first support member 81 abuts against the third or the second plate 59*b*, first support member 81 automatically assumes an upright position. According to this embodiment of the invention, sheets may be discharged even when first support member 81 is in its upright position due to the presence of driving roller 91.

Figure 23:
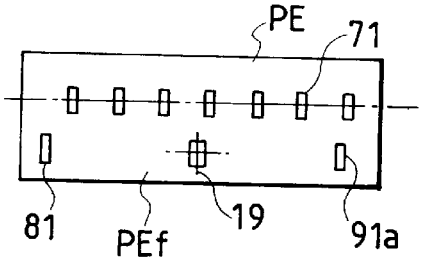
FIGS. 23(*a*)(1), 23(*b*)(1), 23(*c*)(1) and 23(*d*)(1) are a series of schematic plan views depicting the operation of the sheet discharge assembly.
Figure 23:
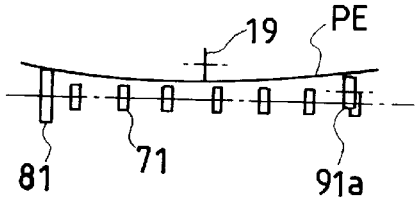
Figure 23:
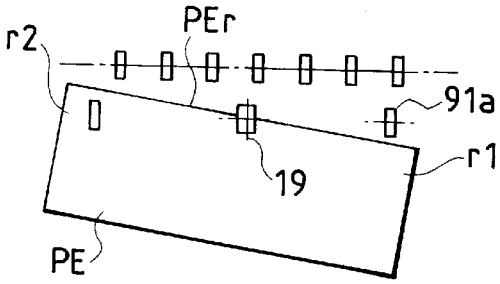
Figure 23:
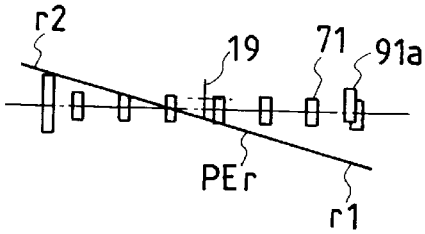
Figure 23:
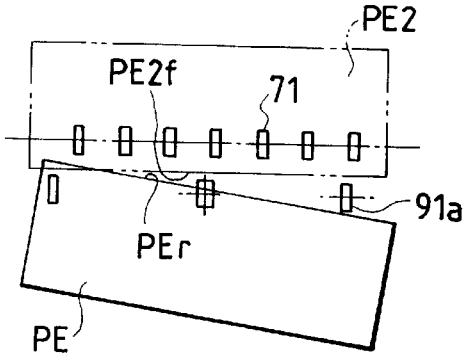
Figure 23:
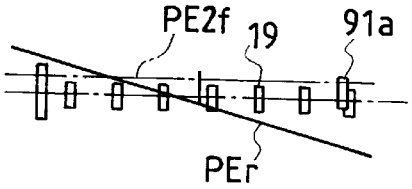
Figure 23:
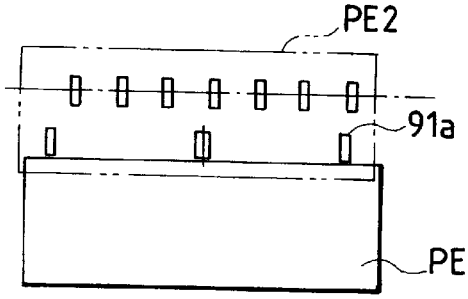
Figure 23:
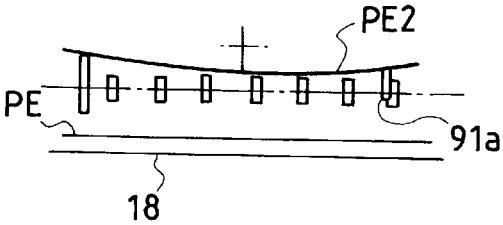

As shown in FIGS. 23(*a*)(1) and 23(*a*)(2), the leading edge PEf of sheet PE is discharged by pairs of discharge rollers 71 and 72 (rollers 72 not shown) such that, while sheet PE is being conveyed, the midpoint in the sheetwidth direction of sheet PE applies an upward force on holder 19*a*, and the leading edge PEf of sheet PE is forced down by holder 19*a*. At the same time, both side portions of the leading edge PEf of sheet PE are supported from below by first support member 81 and roller portion 91 of driving roller 91. The side portion of sheet PE that is supported by driving roller 91 is conveyed forward by the force imparted to sheet PE by roller portion 91*a*. Thus, as shown in FIG. 23(*a*)(2), sheet PE is slowly discharged with the printed side forcibly urged into a concave shape when sheet PE is viewed from the direction in which the sheet is discharged. As such, the discharge of sheet PE is delayed long enough so that the ink printed on preceding sheet PE1 dries before sheet PE rubs against already discharged and stacked sheet PE1 and printed surface PE1*a*.

When sheet PE is conveyed further and the rear edge of sheet PE passes between the pairs of discharge rollers 71 and 72, the conveyance force provided by the pairs of discharge rollers is lost. As shown in FIGS. 23(*b*)(1) and 23(*b*)(2), while one edge of trailing edge PEr2 of sheet PE remains supported by first support member 81, the other one edge PEr1 of trailing edge PEr of sheet PE is conveyed by driving roller 91 until sheet PE losses contact with roller portion 91*a*. Consequently, the trailing edge portion PEr of the sheet is left in a tilted position as shown in FIG. 23(*b*)(2).

While sheet PE is in this position, characters are then printed on subsequent sheet PE2. As shown in FIG. 23(*c*)(1) and 23(*c*)(2), when the leading edge PE2*f* of sheet PE2 passes through pairs of discharge rollers 71 and 72, it abuts against the rear edge PEr of preceding sheet PE, and pushes sheet PE so that sheet PE is stacked on the preceding printed sheet PE1 of sheet tray 18 as shown in FIGS. 23(*d*)(1) and 23(*d*)(2).

Figure 24:
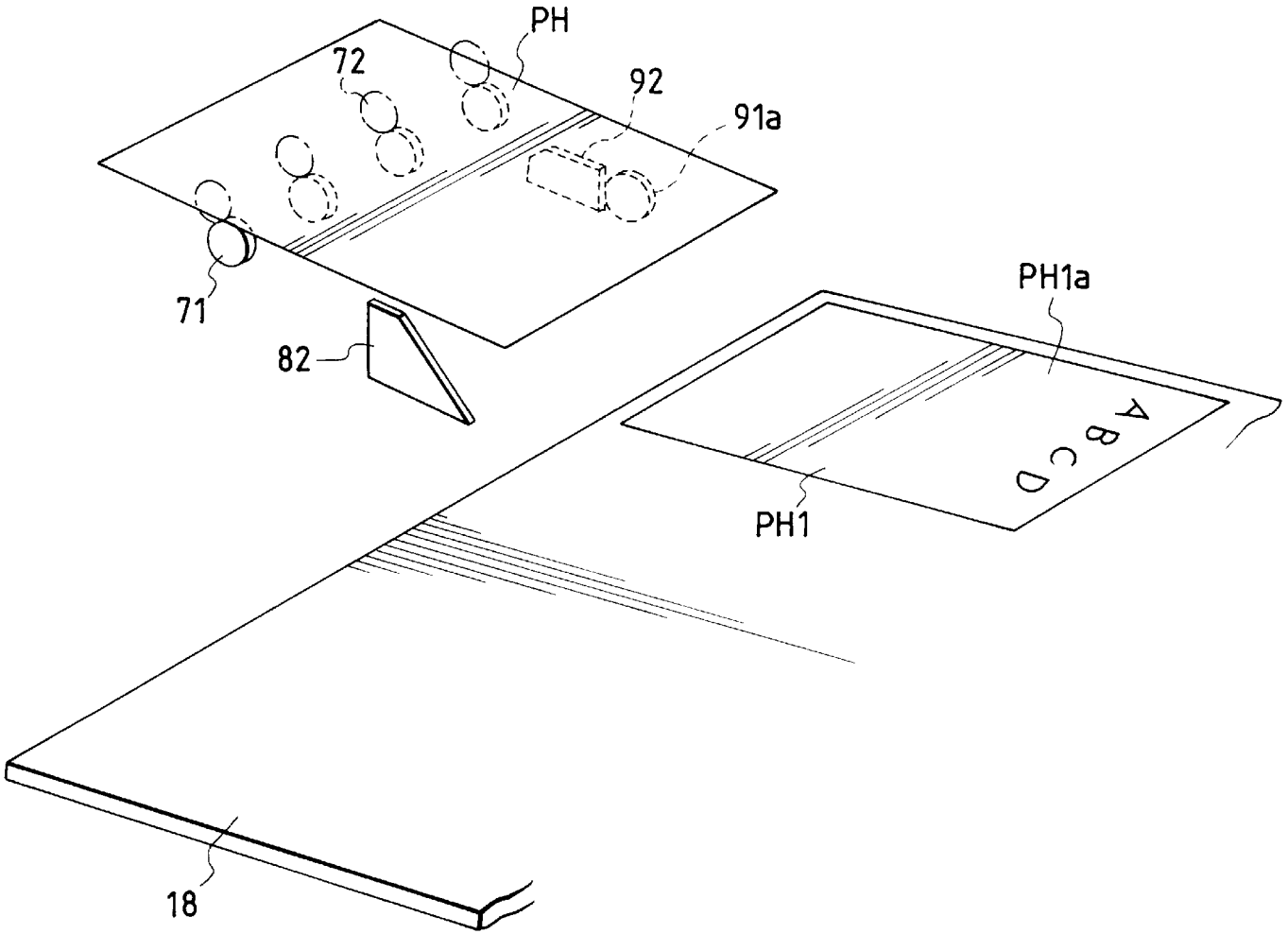
FIG. 24 is a perspective view of the sheet discharge section during sheet discharge operation.

When, for example, printing is desired on small-size envelopes or postcards, and as depicted in FIG. 2, edge guide 23 is positioned close to side plate 16*c*′ of sub frame 16, which forms the second and opposing edge guide, edge guide 23 may be slid from its left-most position to the position shown by the chain line, left support assembly 80 passes switch 59, and first support member 81 automatically assumes a prone position, exposing second support member 82. As shown in FIG. 24, because sheet PH is stiff when sheet PH is discharged by pairs of discharge rollers 71 and 72, sheet PH is discharged in a substantially horizontal condition (the floating condition) by pairs of discharge rollers 71 and 72, until its trailing edge passes through pairs of discharge rollers 71 and 72. Because second support member 82 is situated under sheet PH, and either does not contact or slightly contacts sheet PH at this time, sheet PH encounters little resistance to sheets to be discharged.

Figure 25:
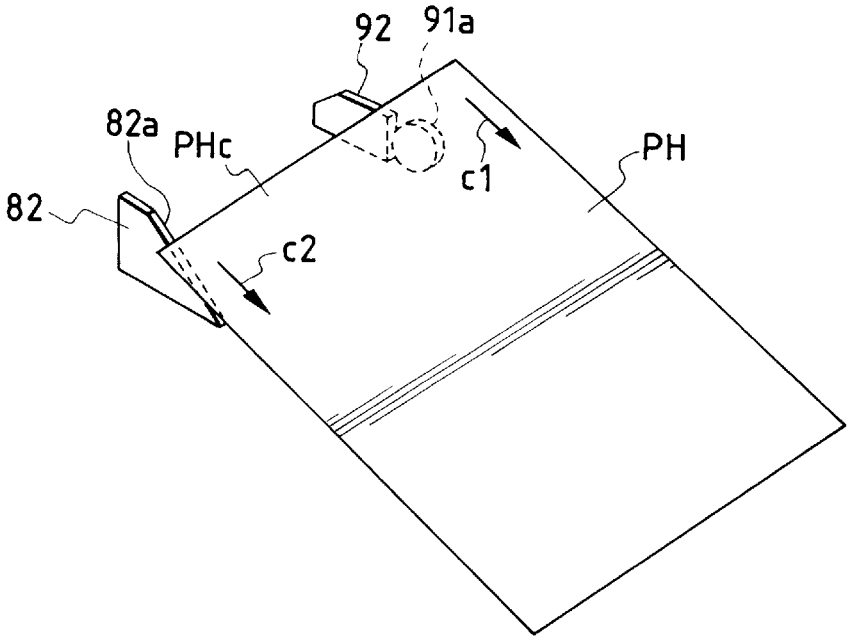
FIG. 25 is a perspective view of the sheet discharge section during sheet discharge operation.

As the sheet is conveyed further, and the trailing edge of the sheet PH passes through pairs of discharge rollers 71 and 72, the driven force is lost. At this point, as shown in FIG. 25, one side of the trailing edge portion PHc of the sheet is conveyed in the direction indicated by arrow c1 by the force of the roller portion 91*a* and the other side of sheet PH slips down the downward-sloping supporting surface 82*a* of second support member 82 as shown by the arrow c2 of FIG. 25. In this way, sheet PH is stacked on the previously printed sheet PH1 (see FIG. 24) such that the time required for sheet PH to come into slidable contact with printed side PH1*a* of preceding sheet PH1, which has been discharged and stacked on sheet tray, is delayed to secure sufficient time for the ink to dry on printed sheet PH1.

As set forth above, the print head of the ink-jet printer described according to the first embodiment of the invention is operated to print characters on the surface of a sheet, which is then discharged while both side portions of the sheet are supported by a pair of supporting portions. Because a driving roller is adapted for use as one of the supporting portions out of the pair of supporting portions, the sheet is discharged by the force applied by the driving roller. Therefore, although the pair of supporting portions are placed in a position relatively higher than discharging sheets, even relatively stiff sheets are smoothly discharged without reduction in feeding accuracy.

Figure 26B:
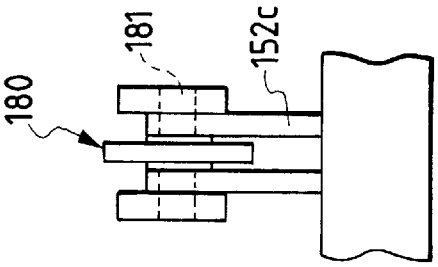
FIG. 26(*a*) is a sectional view of the sheet discharge assembly in accordance with a second embodiment.
Figure 26A:
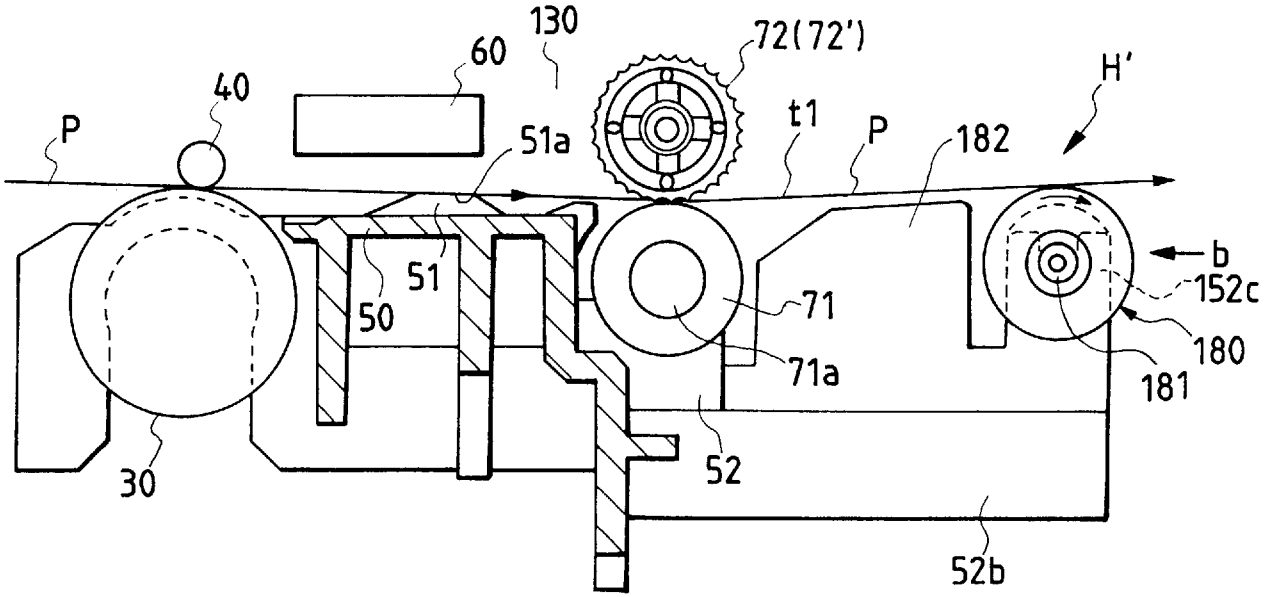
Figure 28:
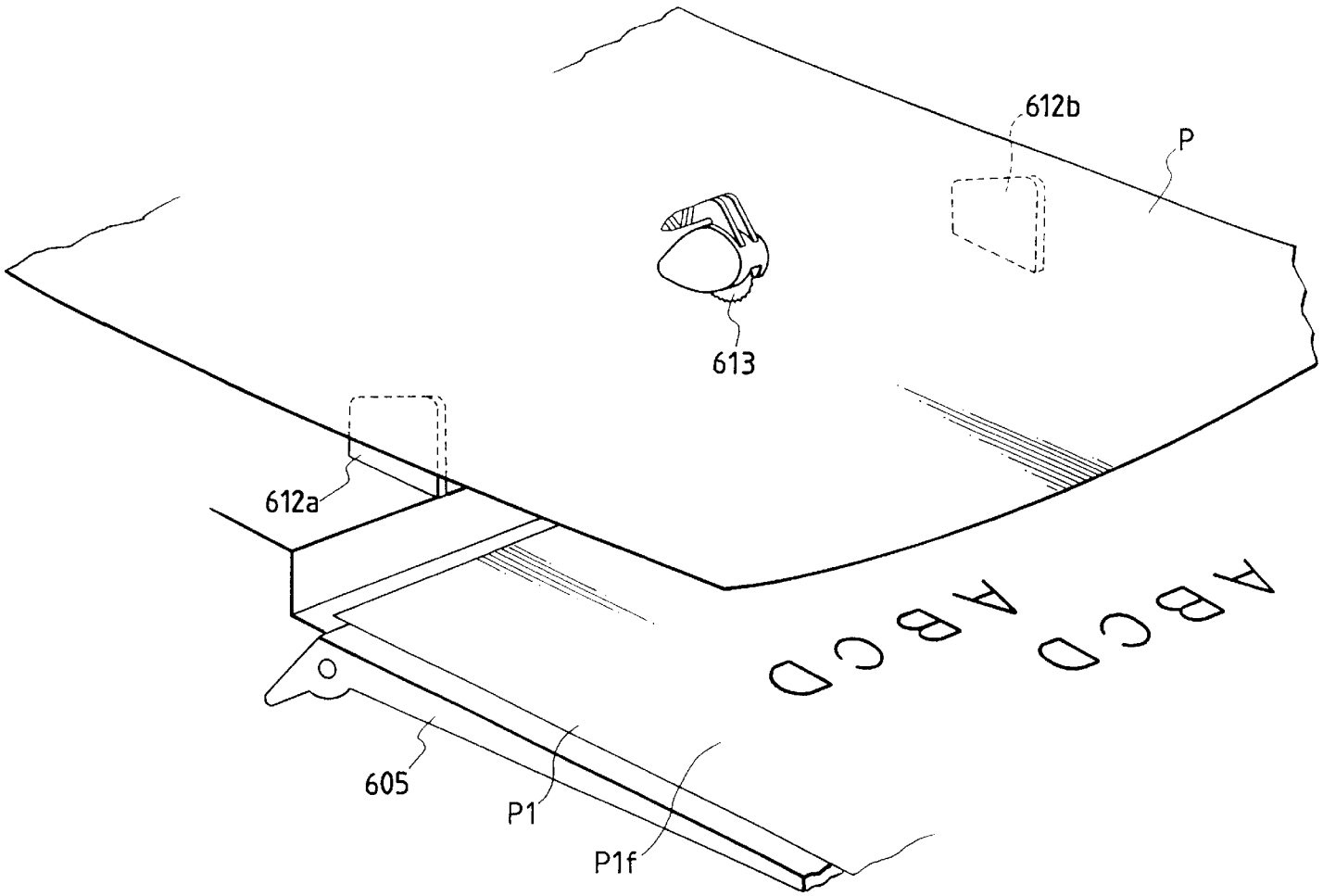
FIG. 28 PRIOR ART
Figure 29:
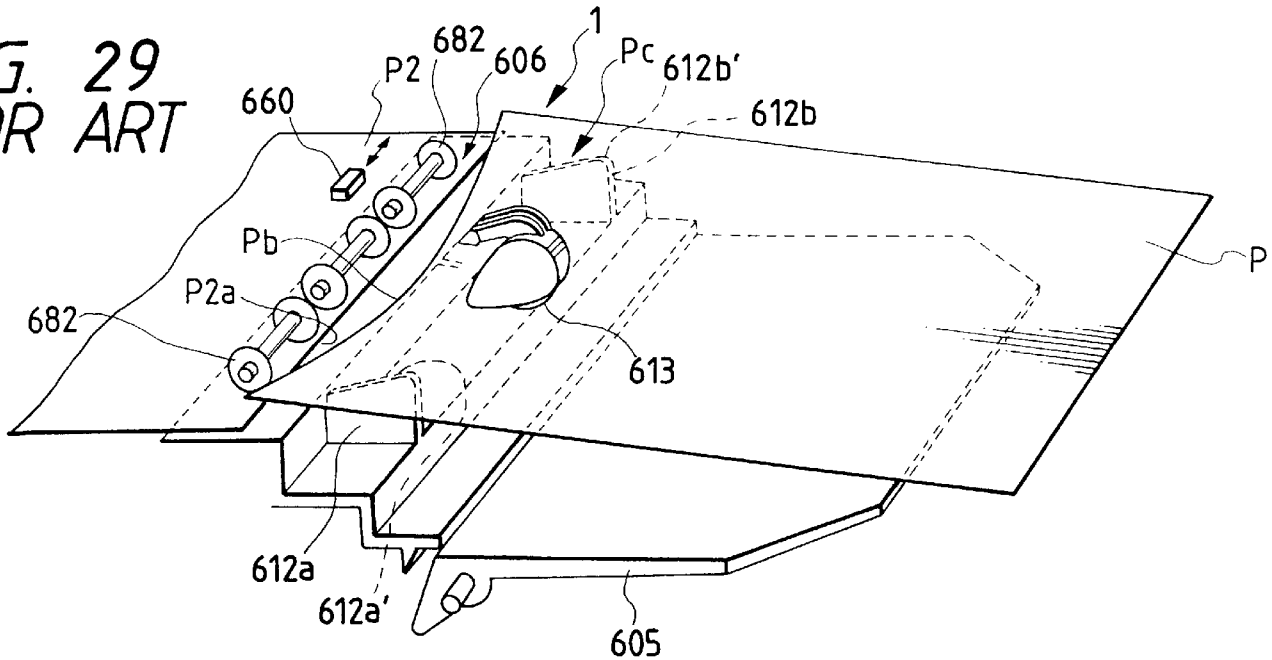
FIG. 29 PRIOR ART

The principal part of a second embodiment of the invention is shown in FIGS. 26(*a*) and 26(*b*). When discussing this embodiment, like reference numerals designate like components, and thus a detailed description of these components is omitted. The sheet discharge portion 130 of the second embodiment unit is constructed differently from the first embodiment.

Sheet discharge portion 130 includes a pair of supporting portions 180 for supporting from below both side portions of sheet P to be discharged and a serrated roller (not shown in FIG. 26) similar to serrated holder 19 according to the first embodiment of the invention. Supporting portion 180 is a driven roller, rotatable by contact with sheet P. Although a pair of driven rollers 180 are installed so that both side portions of a sheet to be discharged are supported from below, only one of them is shown in FIG. 26.

Driven roller 180 is rotatably supported by a shaft 181, which is rotatably supported by a support member 152*c*. Support member 152*c* is integrally formed with base portion 52*b*, which in turn is integrally formed with regulating member 50. Driven roller 180 is supported such that a moderate force causes it to rotate.

Guide plate 182 is functionally different from the prior art support member 612 installed on both sides as shown in FIG. 27 as it is used to guide the leading edge of sheet P to driven roller 181. Therefore, guide plate 182 is positioned at a relatively low height, lower than the height indicated by line t1, which connects the top surface of discharge roller 71 and driven roller 180. Sheet P encounters very little resistance from guide plate 182.

Driven roller 180 is positioned inward relative to the endmost roller 72' in the sheet width direction. In the prior art printer shown in FIG. 27, the supporting surface 612*a* is arranged so that it is situated at the same position (on the extended line in the direction in which sheet is conveyed) as that of the serrated roller 682. As such, when supporting surface 612*a* makes contact with the side portion of the surface of sheet P, side edge Pe of sheet P is soiled as it is urged upward and consequently caused to come in contact with print head 660.

By contrast, according to this embodiment of the invention, the side portion of sheet P is held down by serrated roller 72' because driven roller 180 is situated inward relative to serrated roller 72' for supporting the sheet from below in the sheet width direction. As a result, side edge Pe is prevented from coming into contact with print head 60 and thereby becoming soiled.

As to discharge unit 136, it basically operates in the manner of the prior art discharge unit 601. However, the provision of the pair of driven rollers 180 in place of the prior art support members 612 installed on both sides results in significantly reducing the friction encountered by sheet P. Because of this benefit, even relatively stiff sheets are smoothly discharged without a reduction in feeding accuracy even though the pair of driven rollers 180 are placed in a position relatively higher than the sheet to be discharged. Moreover, no traces of ink left by serrated rollers 71 are left conspicuously on sheet P since it is unnecessary to increase the pressure contact force of the sheet discharge rollers 72 and printing quality is prevented from deteriorating.

The above is an explanation of the embodiments of this invention, but the present invention is not limited to the embodiments described above. That is, variations are also possible while remaining within the scope of the invention. For example, in the first embodiment, supporting portion 80 may be arranged similarly to supporting portion 90 so that it includes a driving roller 91 and a guide plate 92. Further, the roller of supporting portion 80 may be replaced with a driven roller to enable a smooth sheet discharge operation. Even where the roller of supporting portion 80 is made a driven roller, a smooth sheet discharge operation is also achievable as resistance to the discharging sheet is greatly reduced in comparison with support member 81. In addition the means by which driving roller 91 may be improved further by providing roller portion 91*a* of driving roller 91 with a serrated roller like sheet discharge roller 72 so that the discharging sheet may be restrained from contacting the print head.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A device including a sheet discharge section, said discharge section including a body, said discharge section comprising:

at least one pair of discharge rollers for discharging a sheet from said sheet discharge section;

a first support assembly mounted on said body and a second support assembly mounted on said body and spaced apart from said first support assembly, said first and second support assemblies being spaced apart from said at least one pair of discharge rollers in a paper-feed direction, said first support assembly supporting a respective first bottom side portion of a sheet discharged from said body by at least one pair of discharge rollers and said second support assembly supporting a respective second bottom side portion of a sheet discharged by at least one pair of discharge rollers said first support assembly including a driving roller.

2. The device of claim 1, wherein said second support assembly includes a driving roller for conveying said sheet from said sheet discharge section.

3. The device of claim 1, wherein at least one of said first and second support assemblies is disposed out of line with said at least one pair of discharge rollers along the paper feed direction.

4. A device including a sheet discharge section, said discharge section including a body, said discharge section comprising:

a first support assembly mounted on said body and a second support assembly mounted on said body and spaced apart from said first support assembly, said first support assembly supporting a respective first bottom side portion of a sheet discharged from said body and said second support assembly supporting a respective second bottom side portion of a sheet, said first support assembly including a driving roller, said first support assembly including a driving roller for conveying said sheet from said sheet discharge section, said second support assembly including a driven roller rotatable when contacted by a discharging sheet to convey said discharging sheet from said sheet discharge section.

5. A device including a sheet discharge section, and a body, said discharge section comprising:

a first support assembly mounted on said body and a second support assembly mounted on said body and spaced apart from said first support assembly, said first support assembly supporting a respective first bottom side portion of a sheet and said second support assembly supporting a respective second bottom side portion of a sheet, and wherein said first support assembly includes a driven roller, rotatable when contacted by a discharging sheet to convey said discharging sheet from said sheet discharge section, and said second support assembly is moveable between a first position and a second position in a sheet-width direction.

6. The sheet discharge section of claim 5, wherein said second support assembly includes a driving roller.

7. A printer, comprising:

a frame;

a shaft feed roller shaft rotatably mounted on said frame;

a sheet feed roller mounted on said sheet feed roller shaft; and a sheet discharge section having a first and second support assembly mounted on said frame, said first support assembly spaced apart from said second support assembly, said first support assembly constructed and arranged to support a first bottom side portion of a discharging sheet and said second support assembly constructed and arranged to support a second bottom side portion of a discharging sheet, said first support assembly including a driving roller for conveying said discharging sheet from said sheet discharge section; and a gear train assembly rotatable mounted within said frame, operatively coupled to said sheet feed roller shaft, such that, when a sheet is fed by said sheet feed roller, said driving roller is rotated in a paper-feed direction.

8. The sheet discharge section of claim 7, wherein said gear train assembly includes:

a first and second transmission shaft rotatably supported by said frame;

a first gear mounted on said first transmission shaft and a second gear mounted on said second transmission shaft;

at least one feed roller shaft rotatably supported by said frame;

at least one feed roller gear and a sheet feed roller being mounted on said feed roller shaft to rotate therewith;

at least one sheet discharge shaft rotatably supported by said frame;

at least one sheet discharge roller gear being mounted on said sheet discharge shaft to rotate therewith;

a roller shaft rotatably supported by said frame;

a roller gear being mounted on said roller shaft to rotate therewith, said driving roller including a roller portion which rotates with said roller shaft; and wherein said first transmission gear is operatively coupled to said at least one feed roller gear and said at least one sheet discharge roller gear, and said second transmission gear is operatively coupled to said at least one sheet discharge roller gear and said roller gear.

* * * * *

UNITED STATES PATENT AND TRADEMARK OFFICE

CERTIFICATE OF CORRECTION

PATENT NO. : 5,807,003

DATED : September 15, 1998

INVENTOR(S) : Yoichi Kobayashi, et al.

It is certified that error appears in the above-identified patent and that said Letters Patent is hereby corrected as shown below:

Column 21, lines 63 and 64, delete "said first support assembly including a driving roller,".

Signed and Sealed this

Sixth Day of April, 1999

*Attest:*

Q. TODD DICKINSON

*Attesting Officer*

*Acting Commissioner of Patents and Trademarks*